US012070161B2

(12) United States Patent
Heegaard et al.

(10) Patent No.: US 12,070,161 B2
(45) Date of Patent: Aug. 27, 2024

(54) PORTABLE SUPPORT CUSHION

(71) Applicant: Rena Queen Heegaard, Eden Prairie, MN (US)

(72) Inventors: Rena Queen Heegaard, Eden Prairie, MN (US); Andrew Bowen, San Francisco, CA (US)

( * ) Notice: Subject to any disclaimer, the term of this patent is extended or adjusted under 35 U.S.C. 154(b) by 0 days.

(21) Appl. No.: 17/981,385

(22) Filed: Nov. 4, 2022

(65) Prior Publication Data

US 2023/0146446 A1 May 11, 2023

Related U.S. Application Data

(60) Provisional application No. 63/276,152, filed on Nov. 5, 2021.

(51) Int. Cl.
*A47K 13/24* (2006.01)

(52) U.S. Cl.
CPC ..... *A47K 13/24* (2013.01)

(58) Field of Classification Search
CPC ..... A47K 13/24
USPC ..... 4/234
See application file for complete search history.

(56) References Cited

U.S. PATENT DOCUMENTS 1,726,417 A 8/1929 Wren
2,582,321 A 1/1952 Farrell
2,642,582 A 6/1953 Patton
3,014,761 A 12/1961 Otto
3,263,245 A * 8/1966 Ettinger ..... A47K 17/02 297/352
3,279,849 A 10/1966 Radke et al.
3,977,028 A 8/1976 Chang
3,988,789 A 11/1976 Blount
4,318,213 A 3/1982 Blount
4,469,728 A 9/1984 Belz
4,819,278 A 4/1989 Ramos
D314,043 S 1/1991 Beller et al.
D353,738 S * 12/1994 Tran ..... D23/311
5,533,787 A 7/1996 Xiang
5,619,757 A 4/1997 Baratta
5,685,029 A 11/1997 Gee
5,809,582 A 9/1998 Lane
(Continued)

OTHER PUBLICATIONS

Design Application No. 370303-001 Government of India Examination Report, Dec. 12, 2022, 2 pages.
(Continued)

*Primary Examiner* — Huyen D Le
(74) *Attorney, Agent, or Firm* — Daniel A. Rosenberg; Taft Stettinius & Hollister LLP

(57) ABSTRACT

A portable support cushion includes a cushion body, a cushion cover, and a support pouch. The cushion cover surrounds the cushion body so as to enclose the cushion body therein. The support pouch is coupled to the cover and is changeable between an expanded arrangement and a collapsed arrangement. The support pouch comprises an elastic material. In the expanded arrangement, the support pouch is stretched and arranged around a cushion support such that elastic force of the elastic material causes the support pouch to grasp the cushion support to mount the support cushion on the cushion support, which may be a toilet seat lid. The cushion may be used on either surface of a toilet seat lid or as a lower body support on a floor surface.

20 Claims, 14 Drawing Sheets

(56) References Cited

U.S. PATENT DOCUMENTS

| | | | | |
|---|---|---|---|---|
| 5,809,852 | A | 9/1998 | Haskell | |
| 6,052,840 | A | 4/2000 | West et al. | |
| 6,142,565 | A | 11/2000 | Rieder | |
| D446,289 | S | 8/2001 | Dabner | |
| 6,904,622 | B1 | 6/2005 | Gabriel | |
| 6,996,859 | B1 | 2/2006 | Alonso et al. | |
| 7,020,907 | B2 | 4/2006 | Holmes | |
| 7,213,887 | B2 | 5/2007 | Dudash et al. | |
| D600,335 | S | 9/2009 | Cleppe | |
| 7,891,030 | B1 | 2/2011 | Sutton | |
| D644,831 | S | 9/2011 | Smith | |
| 8,955,171 | B1 | 2/2015 | Ariche | |
| 9,119,508 | B2 | 9/2015 | Reed | |
| 9,339,157 | B2 | 5/2016 | Sarkar | |
| D765,230 | S * | 8/2016 | Dabner | D23/311 |
| 9,486,119 | B2 | 11/2016 | Laundre | |
| 9,901,225 | B1 | 2/2018 | Haralovich | |
| 10,004,630 | B2 | 6/2018 | Saitoh et al. | |
| 10,016,101 | B2 | 7/2018 | Schottenstein et al. | |
| 10,049,597 | B2 | 8/2018 | Mccarthy et al. | |
| 10,080,440 | B2 | 9/2018 | Nelson | |
| 10,105,021 | B1 | 10/2018 | Mcguire | |
| 10,154,764 | B2 | 12/2018 | Khaytman | |
| 10,390,667 | B2 | 8/2019 | Blair et al. | |
| 10,575,687 | B1 | 3/2020 | Ehrenberg | |
| 2003/0127890 | A1 | 7/2003 | Moon | |
| 2004/0255371 | A1 | 12/2004 | Shelton | |
| 2007/0089225 | A1 | 4/2007 | Wolf | |
| 2008/0086804 | A1 | 4/2008 | Goh Aow | |
| 2009/0013455 | A1 | 1/2009 | Richardson | |
| 2010/0083419 | A1 | 4/2010 | Jackson | |
| 2014/0013496 | A1 | 1/2014 | Blair et al. | |
| 2015/0021963 | A1 | 1/2015 | Reed | |
| 2015/0196178 | A1 | 7/2015 | Schottenstein et al. | |
| 2015/0366417 | A1 | 12/2015 | Grant | |
| 2016/0022100 | A1 | 1/2016 | Khaytman | |
| 2019/0186115 | A1 | 6/2019 | Schwab et al. | |
| 2019/0357738 | A1 | 11/2019 | Cominotti et al. | |
| 2019/0374077 | A1 | 12/2019 | Blair et al. | |

OTHER PUBLICATIONS

Notification of Design for Chinese Patent Application No. 202230592332.9, Dec. 2, 2022, 1 page.

India Examination Report for corresponding Application No. 370301-001, 2 pages (Nov. 7, 2022).

India Examination Report for corresponding Application No. 370300-001, 2 pages (Nov. 23, 2022).

* cited by examiner

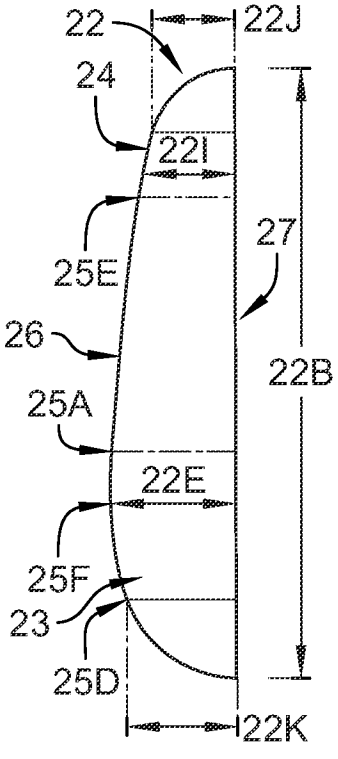
FIG. 4C
FIG. 4B
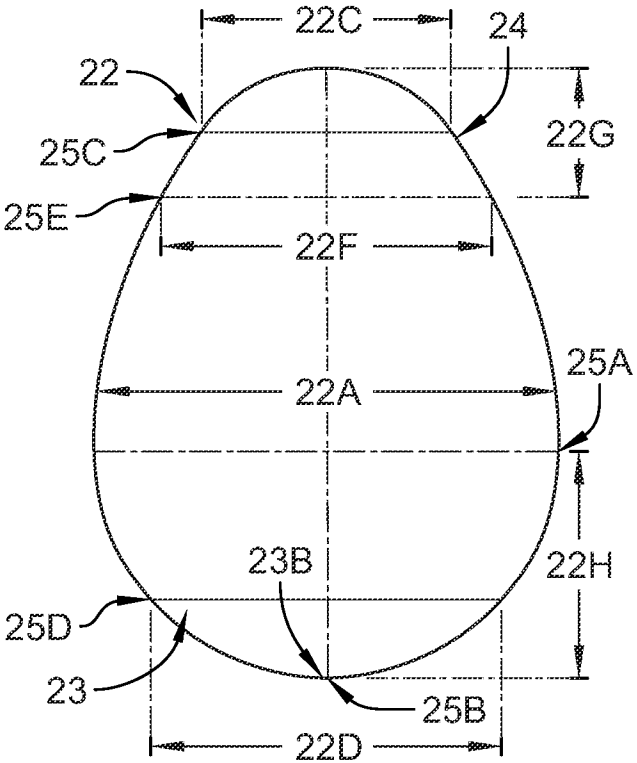
FIG. 4A

PORTABLE SUPPORT CUSHION

CROSS-REFERENCE TO RELATED APPLICATIONS

This application claims the benefit of priority of U.S. Provisional Application 63/276,152, which was filed on Nov. 5, 2021, the disclosure of which is incorporated herein by reference in its entirety.

TECHNICAL FIELD

The disclosure relates to portable cushions, and more particularly, portable cushions having multiple use configurations including toilet seat lids.

BACKGROUND

The bathroom toilet provides a utilitarian function but typically does not include features designed to enhance the relaxation and comfort of the user, despite the desires of consumers for a comfortable, spa-like, and aesthetically pleasing experience in the bathroom. Typical cushion devices struggle to provide high comfort while also providing maximum versatility. As such, it would be advantageous to provide a pillow device that is highly versatile in its potential usages in a bathroom as well as other areas of the home.

SUMMARY

According to a first aspect of the present disclosure, a toilet system includes a toilet and a portable support cushion. The toilet includes a bowl, a toilet seat pivotably arranged on a top rim of the bowl, and a toilet seat lid pivotably arranged above the toilet seat, the toilet seat lid including a bottom surface that faces the toilet seat in a lowered position when the toilet seat lid is resting on top of the toilet seat and a top surface opposite the bottom surface. The portable support cushion includes a cushion body including a front body surface configured to engage a body of a user and a rear body surface arranged to face opposite the front body surface, and a cushion cover surrounding the cushion body so as to enclose the cushion body therein, the cushion cover including a front cover surface adjacent the front body surface and a rear cover surface adjacent the rear body surface.

The support pouch is coupled to the rear cover surface and changeable between an expanded arrangement and a collapsed arrangement, the support pouch comprising an elastic material. In the expanded arrangement, the support pouch is configured to be stretched and arranged around at least a portion of the toilet seat lid such that elastic force of the elastic material causes the support pouch to grasp the toilet seat lid so as to mount the portable support cushion on the toilet seat lid.

In some embodiments, in the expanded arrangement, the support pouch is formed to include a pouch cavity and a pouch opening arranged to open into the pouch cavity, and, in the expanded arrangement, the toilet seat lid extends through the pouch opening and into the pouch cavity when the portable support cushion is mounted on the toilet seat lid.

In some embodiments, the support pouch includes a rear wall and a perimeter side wall arranged to extend between and interconnect the rear wall and the rear cover surface. The pouch cavity is defined, at least in part, to be between the rear wall, the perimeter side wall, and the rear cover surface. In the expanded arrangement, the rear wall is arranged on one of the bottom and top surface of the toilet seat lid and the rear cover surface is arranged on the other of the bottom and top surface of the toilet seat lid when the portable support cushion is mounted on the toilet seat lid.

In some embodiments, in the expanded arrangement, the rear wall of the support pouch is spaced apart from the rear cover surface so as to define the pouch cavity, and, in the collapsed arrangement, the perimeter side wall is collapsed such that the rear wall is located adjacent to the rear cover surface.

In some embodiments, in the expanded arrangement, an inner top portion of the perimeter side wall of the support pouch is arranged on a top side of the toilet seat lid when the portable support cushion is mounted on the toilet seat lid. The support pouch is positioned on the cushion cover such that a bottommost end of the cushion body and the cushion cover is spaced apart from a bottommost terminal end of the toilet seat lid closest to the toilet seat.

In some embodiments, the support pouch is arranged on a top half of the rear cover surface such that a bottom half of the rear cover surface is configured to contact the toilet seat lid, and wherein the rear wall is generally parallel with the rear cover surface.

In some embodiments, in a first use arrangement, the support pouch is arranged on the top side of the toilet seat lid when the toilet seat lid is in a raised position away from the toilet seat such that the cushion body is arranged on the bottom surface of the toilet seat lid.

In some embodiments, in a second use arrangement, the support pouch is arranged on the top side of the toilet seat lid when the toilet seat lid is in the lowered position such that the cushion body is arranged on the top surface of the toilet seat lid.

In some embodiments, in a third use arrangement, the support pouch is arranged in the collapsed arrangement such that a rear wall of the support pouch is substantially aligned with the rear cover surface so as to allow the poi support cushion to rest on a flat surface on the rear cover surface such that a user can rest on the portable support cushion.

According to a further aspect of the present disclosure, a portable support cushion includes a cushion body, a cushion cover, and a support pouch. The cushion body includes a front body surface configured to engage a body of a user and a rear body surface arranged to face opposite the front body surface. The cushion cover surrounding the cushion body so as to enclose the cushion body therein, the cushion cover including a front cover surface adjacent the front body surface and a rear cover surface adjacent the rear body surface. The support pouch coupled to the rear cover surface and changeable between an expanded arrangement and a collapsed arrangement, the support pouch comprising an elastic material. In the expanded arrangement, the support pouch is configured to be stretched and arranged around at least a portion of a cushion support such that elastic force of the elastic material causes the support pouch to grasp the cushion support so as to mount the portable support cushion on the cushion support.

In some embodiments, in the expanded arrangement, the support pouch is formed to include a pouch cavity and a pouch opening arranged to open into the pouch cavity, and, in the expanded arrangement, the cushion support extends through the pouch opening and into the pouch cavity when the portable support cushion is mounted on the cushion support.

In some embodiments, the support pouch includes a rear wall and a perimeter side wall extending between and interconnecting the rear wall and the rear cover surface. The pouch cavity is defined between the rear wall, the perimeter side wall, and the rear cover surface. The expanded arrangement, the rear wall is arranged on a first support surface of the cushion support and the rear cover surface is arranged on a second support surface of the cushion support opposite the first support surface in the expanded arrangement when the portable support cushion is mounted on the cushion support and, in the expanded arrangement, the rear wall of the support pouch is spaced apart from the rear cover surface so as to define the pouch cavity, and, in the collapsed arrangement, the perimeter side wall is collapsed such that the rear wall is located adjacent to the rear cover surface.

In some embodiments, in the expanded arrangement, an inner top portion of the perimeter side wall of the support pouch is arranged on a top end of the cushion support when the portable support cushion is mounted on the cushion support. The support pouch is positioned on the cushion cover such that a bottommost end of the cushion body and the cushion cover is spaced apart from a bottommost terminal end of the cushion support.

In some embodiments, the support pouch is arranged on a top half of the rear cover surface such that a bottom half of the rear cover surface is configured to contact the cushion support, and the rear wall is generally parallel with the rear cover surface.

In some embodiments, the cushion cover includes an opening on a bottommost side of the cushion cover that is selectively openable and closable via a zipper, the opening configured to allow the cushion body to be removed from the cushion cover when the opening is opened via the zipper.

In some embodiments, the cushion cover further includes a flap strip that extends over an entirety of the opening and the zipper, the opening extends from a first terminal end located on a first lateral side of the cushion cover to a second terminal end located on a second lateral side of the cushion cover opposite the first lateral side, and the flap strip extends from the first terminal end to the second terminal end of the opening.

In some embodiments, a first longitudinal edge of the flap strip is a hinge edge that is attached to the cushion cover and a second longitudinal edge of the flap strip opposite the first longitudinal edge is not attached to the cushion cover so as to allow the flap strip to pivot about the hinge edge between an opened arrangement in which the zipper is exposed to a surrounding environment and a closed arrangement in which the zipper is covered.

According to a further aspect of the present disclosure, a method of using a portable support cushion includes providing a toilet seat lid of a toilet having a bottom surface that faces a toilet seat of the toilet in a lowered position and a top surface opposite the bottom surface, arranging the toilet seat lid in a raised position away from the toilet seat, and arranging a support pouch of the portable support cushion that is arranged on a rear side of a cushion body of the portable support cushion on a top side of the toilet seat lid such that the cushion body is arranged on the bottom surface of the toilet seat lid and is aligned with a lumbar region of a user so as to allow the user to lean back on the portable support cushion.

In some embodiments, the method further includes removing the support pouch from the top side of the toilet seat lid so as to remove the portable support cushion from the toilet seat lid, moving the toilet seat lid to the lowered position, and arranging the support pouch on the top side of the toilet seat lid such that the cushion body is arranged on the top surface of the toilet seat lid and is aligned with an underside of an upper leg region of the user so as to allow the user to sit on the portable support cushion.

In some embodiments, the method further includes removing the support pouch from the top side of the toilet seat lid so as to remove the portable support cushion from the toilet seat lid, moving the support pouch to a collapsed arrangement such that a rear wall of the support pouch is substantially aligned with a rear surface of the cushion body, and arranging the portable support cushion on a flat surface on the rear surface of the cushion body such that the user can rest on the portable support cushion.

BRIEF DESCRIPTION OF THE DRAWINGS

FIG. 4A is a front view of the cushion body of the portable support cushion of FIG. 1A;

FIG. 4B is a side view of the cushion body of the portable support cushion of FIG. 1A;

FIG. 4C is a top view of the cushion body of the portable support cushion of FIG. 1A;

DETAILED DESCRIPTION

Figure 1B:
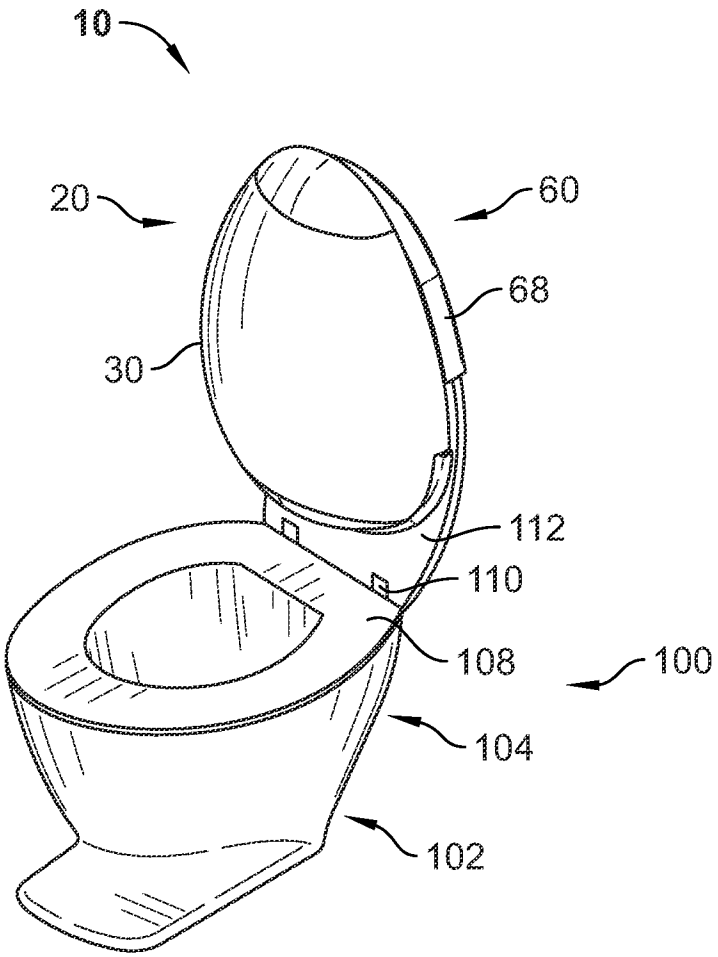
FIG. 1B is a perspective view of the portable support cushion of FIG. 1A showing the cushion arranged on a toilet seat lid.
Figure 1A:
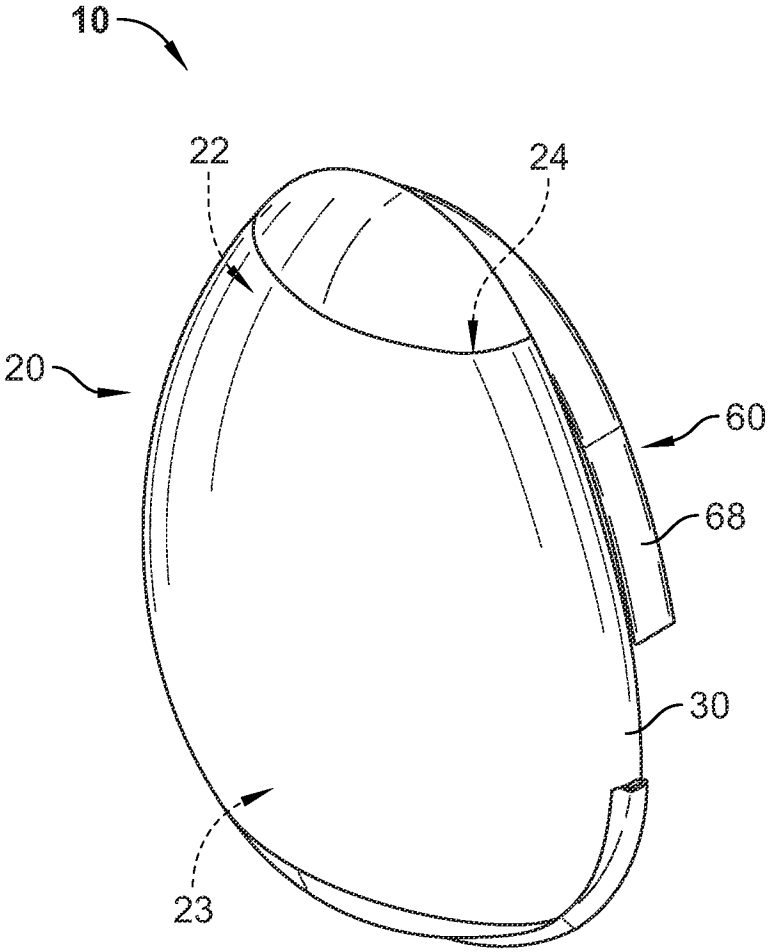
FIG. 1A is perspective view of a portable support cushion according to a first aspect of the present disclosure showing the cushion includes a cushion cover and a support pouch on a rear of the cushion cover.

According to a first aspect of the present disclosure, a portable cushion support 10 includes a cushion body assembly 20 having a cushion body 22 and a cushion cover 30, and a support pouch 60 coupled to the cushion cover 30, as shown in FIGS. 1A-2B. The support pouch 60 is configured to be stretched over a support surface, for example a bottom surface 113 of a toilet seat lid 112 of a toilet 102 (i.e. the surface 113 of the lid 112 that faces downwardly when the lid 112 is closed on top of a toilet seat 108 of the toilet 102), so as to support the cushion body assembly 20, and thus the portable support cushion 10, thereon, as shown in detail in FIGS. 1B-2B. The portable support cushions 10 of the present disclosure provide enhanced versatility, comfort and relaxation, aesthetic appeal, convenience, and/or ease of use. The disclosed support cushions 10 may be beneficial for anyone who spends extended periods of time in area which typically do not provide the utmost comfort, such as the bathroom. For example, the disclosed cushions may be beneficial for parents of small children who experience the need for comfort and relaxation while caring for their children in the bathroom. The support cushions 10 described herein are soft and cushioning, and provide comfort, support, and relaxation for the user 200 while sitting on the toilet 102 or other typically uncomfortable support surfaces. In this manner, the support cushions 10 described herein turn a typical toilet 102 into a relaxing spa-like experience to give the user 200 the opportunity to sit back, relax and unwind.

The support cushions 10 described herein also may be reversible to provide a cushioning seat on the top surface 114 of the closed toilet lid 112 (i.e. the surface 114 of the lid 112 that faces upwardly when the lid 112 is closed on top of the toilet seat 108), allowing a user 200 to sit on the closed toilet seat lid 112 or providing protection of a toilet tank 116 of the toilet 112 or wall behind the toilet when the seat is opened. When reversed and used as a cushioning seat, the support cushion 10 provides the same comfortable and relaxing experience for the user 200. Furthermore, the support cushion 10 may be removed from the toilet lid 112 and used as a cushion for kneeling on the floor 92 or other support positions. A person skilled in the art will understand that any reference to toilet seat lids 112 may also refer to other potential support surfaces, such as a chair back or similar seat device.

Figure 3B:
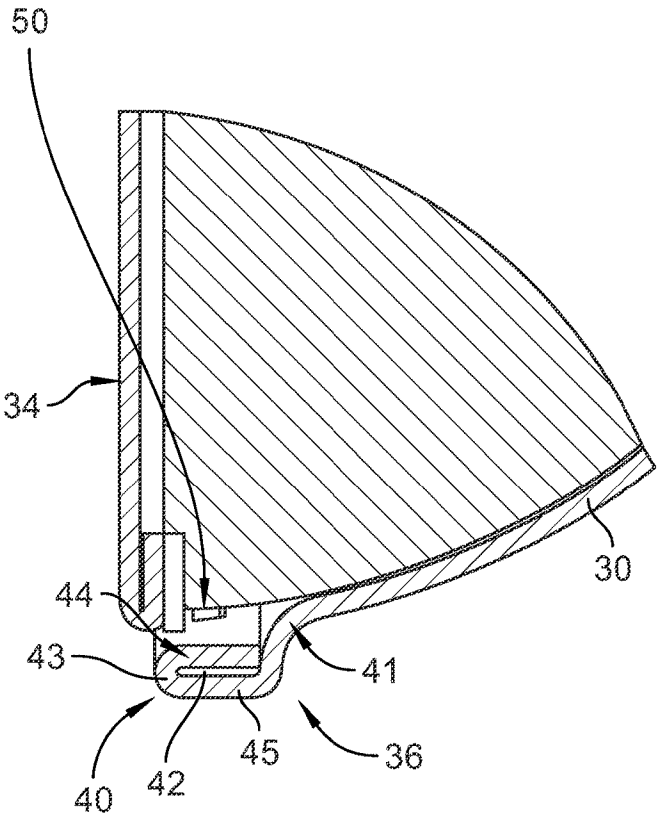
FIG. 3B shows a magnified view of a flap covering a zipper of the portable support cushion of FIG. 1A.
Figure 3A:
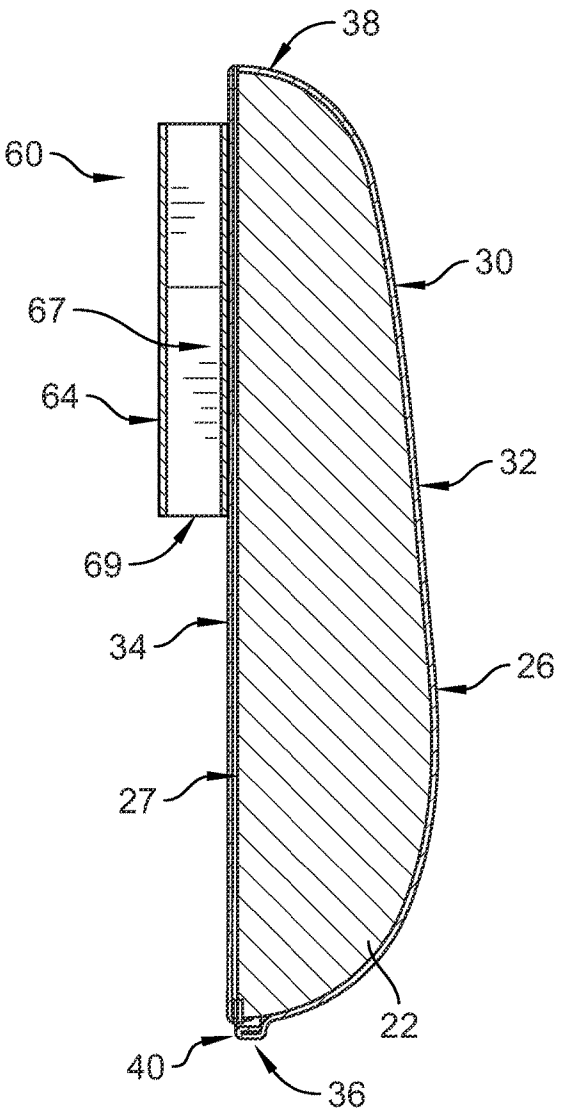
FIG. 3A is a side cross-section view of the portable support cushion of FIG. 1A showing the cushion includes a cushion body and the cushion cover surrounding and enclosing the cushion body.

Illustratively, the cushion body 22 may include a pillow or any other soft, compressible, resilient body configured to provide soft yet supportive surface for a user 200. As can be seen, for example, in FIGS. 1A and 3A, the cushion body 22 can be formed to be substantially egg-shaped, having a generally oval shape with a bottom portion that is wider and thicker than the top portion of the body 22. In some embodiments, the cushion body 22 may also include a curved, egg-like shape when viewed from the side, as shown in FIGS. 3A and 4B, having a portion located on the bottom half of the body 22 towards the bottom side 23 that is thicker than the portion located on the top half of the body 22 located towards the top side 24 (see reference numeral 22E in FIG. 4B). The shape of the cushion body 22 may be formed to substantially match the outer contour of a typical toilet seat lid 112, which may be egg-shaped as well. A person skilled in the art will understand that the egg-like shape when viewed from the side may be modified to be more or less angled based on the design requirements of the support cushion 10, so long as the portion located on the bottom half of the body 22 towards the bottom side 23 is thicker than the portion located on the top half of the body 22 located towards the top side 24. This shaping provides a design that substantially matches the contour of the human lower back lumbar area.

In other embodiments, the cushion body 22 may be formed of a different shape based on the intended support surfaces (i.e. various toilet seat lids) and desired design configurations of the support cushion 10, such as circular, rectangular, or square. The cushion body 22 may be made from any suitable material known in the art. For example, the cushion body 22 may comprise a memory foam or polyurethane material that is molded to form the desired shape of the support cushion 10, as shown in FIGS. 3A and 3B. In some embodiments, the material of the cushion body 22 may comprise gel, inflatable PVC, and other soft and supportive materials as would be understood by a person skilled in the art. The firmness of the cushion body 22 may be varied to provide the desired level of softness or support.

FIGS. 4A-4C show a non-limiting example of a configuration of the cushion body 22. In some embodiments, the cushion body 22 may include dimensions that provide good versatility for use with various toilet seat lid 112 shapes and sizes. For example, the cushion body 22 may include a central width 22A measured at a widest plane 25A of the body 22 in a range of 300 mm to 350 mm, and in particular, approximately 328 mm. The cushion body 22 may include a central height 22B measured at a highest, central plane 25B of the body 22 in a range of 400 mm to 450 mm, and in particular, approximately 429 mm. The cushion body 22 may include a top side width 22C measured at a top side plane 25C in a range of 150 mm to 200 mm, and in particular, approximately 176 mm. The cushion body 22 may include a bottom side width 22D measured at a bottom side plane 25D in a range of 225 mm to 275 mm, and in particular, approximately 250 mm. The cushion body 22 may include a maximum thickness 22E measured at the thickest plane 25F of the body 22 in a range of 70 mm to 100 mm, and in particular, approximately 86 mm.

By way of further non-limiting examples, the cushion body 22 may include a midway width and thickness 22F, 22I measured at a top midway plane 25E located between the top side plane 22C and the widest plane 25A in a range of 200 mm to 250 mm, and in particular, approximately 232 mm. A distance between the top midway plane 25E and the topmost point of the body 22 may be in a range of 80 mm to 100 mm, and in particular, approximately 91 mm. A distance between the widest plane 25A and the bottommost point of the body 22 may be in a range of 140 mm to 180 mm, and in particular, approximately 160 mm. The cushion body 22 may include a top thickness 22J measured at the top side plane 25C in a range of 40 mm to 80 mm, and in particular, approximately 58 mm. The cushion body 22 may include a bottom thickness 22K measured at the bottom side plane 25D in a range of 60 mm to 100 mm, and in particular, approximately 76 mm.

Illustratively, the cushion body 22 includes a front both surface 26 configured to engage the body of the user 200, in particular by absorbing the users 200 weight and providing a soft support surface, and a rear body surface 27 arranged to face opposite the front body surface 26. The cushion body 22 may also include rounded outer portions 28, 29, as shown in FIG. 4C, that curve from the thickest middle plane located at the central plane 25B on the front body surface 26 toward the outer sides of the rear both surface 27. In having the thickest point of the both 22 at the center of the both 22, i.e.

where the widest plane 25A and the central plane 25B intersect on the front body surface 26, maximal lumbar support is provided to the user 200 due to this thickest portion contacting the lumbar area of the user 200.

As shown in FIGS. 1A-3B and 5A-7B, the portable support cushion 10 further includes the cover 30. The cover 30 is configured to surround the cushion both 22 so as to enclose the cushion body 22 therein. The cushion cover 30 including a front cover portion 32, or a front cover surface, located adjacent the front body surface 26 when the cover 30 is arranged on the cushion body 22, and a rear cover surface 34 adjacent the rear body surface 27 when the cover 30 is arranged on the cushion body 22. The front cover surface 32 is configured to directly engage the user 200, while the rear cover surface 34 engages a support surface, such as one of the surfaces of the toilet lid 112 or a floor 92.

Illustratively, the cover 30 may be formed of any suitable material that allows the cover 30 to securely surround the cushion body 22. For example, the cover 30 may be formed of a material having some stretchability, allowing for the cover 30 to tightly fit around the cushion body 22. In some embodiments, the cover 30 may comprise polyurethane materials and be treated with an antimicrobial agent. The stretchability of the cover 30 also allows for easy removal of the cover 30 from the cushion body 22 for cleaning or other purposes. The cover 30 may also be provided in various colors and/or patterns so as to fit the color scheme of the users 200 bathroom and/or certain periods of the year. In some embodiments, a middle portion 37 of the front surface 32 of the cover 30 is stitched to a top portion 38 on a top side of the middle portion 37, and the middle portion 37 is also stitched to a bottom portion 39 of the cover 30 on a bottom side of the middle portion 37.

Illustratively, the cushion cover 30 can be formed to substantially match the shape of the cushion body 22, as shown in FIGS. 3A, 5A-5E, and 6. In particular, the cover 30 may also be substantially egg-shaped, having a generally oval shape with a bottom portion that is wider and thicker than the top portion of the cover. In some embodiments, the cover 30 may also include a curved, egg-like shape when viewed from the side, as shown in FIGS. 3A and 4B, having a portion located on the bottom half of the cover 30 towards a bottom side 35 that is thicker than the portion located on the top half of the cover 30 located towards a top side 38 (see reference numeral 30E in FIG. 5C).

FIGS. 5A-5E show a non-limiting example of a configuration of the cushion cover 30. In some embodiments, the coves 30 may include dimensions that provide good versatility for use with various toilet seat lid 112 shapes and sizes, as well as with various shapes of cushion bodies 22. As particularly applicable to the cushion body 22 described above, the cushion cover 30 may include a central width 30A measured at a widest plane 35A of the cover in a range of 300 mm to 350 mm, and in particular, approximately 332 mm. The cushion cover 30 may include a central height 30B measured at a highest, central plane 35B of the cover 30 in a range of 400 mm to 450 mm, and in particular, approximately 433 mm. The cushion cover 30 may include a top side width 30C measured at a top side plane 25C in a range of 150 mm to 200 mm, and in particular, approximately 178 mm. The cushion cover 30 may include a bottom side width 30D measured at a bottom side plane 35D in a range of 225 mm to 275 mm, and in particular, approximately 247 mm. The cushion cover 30 may include a maximum thickness 30E measured at the thickest plane 35E of the cover 30 in a range of 80 mm to 110 mm, and in particular, approximately 95 mm.

Figure 6:
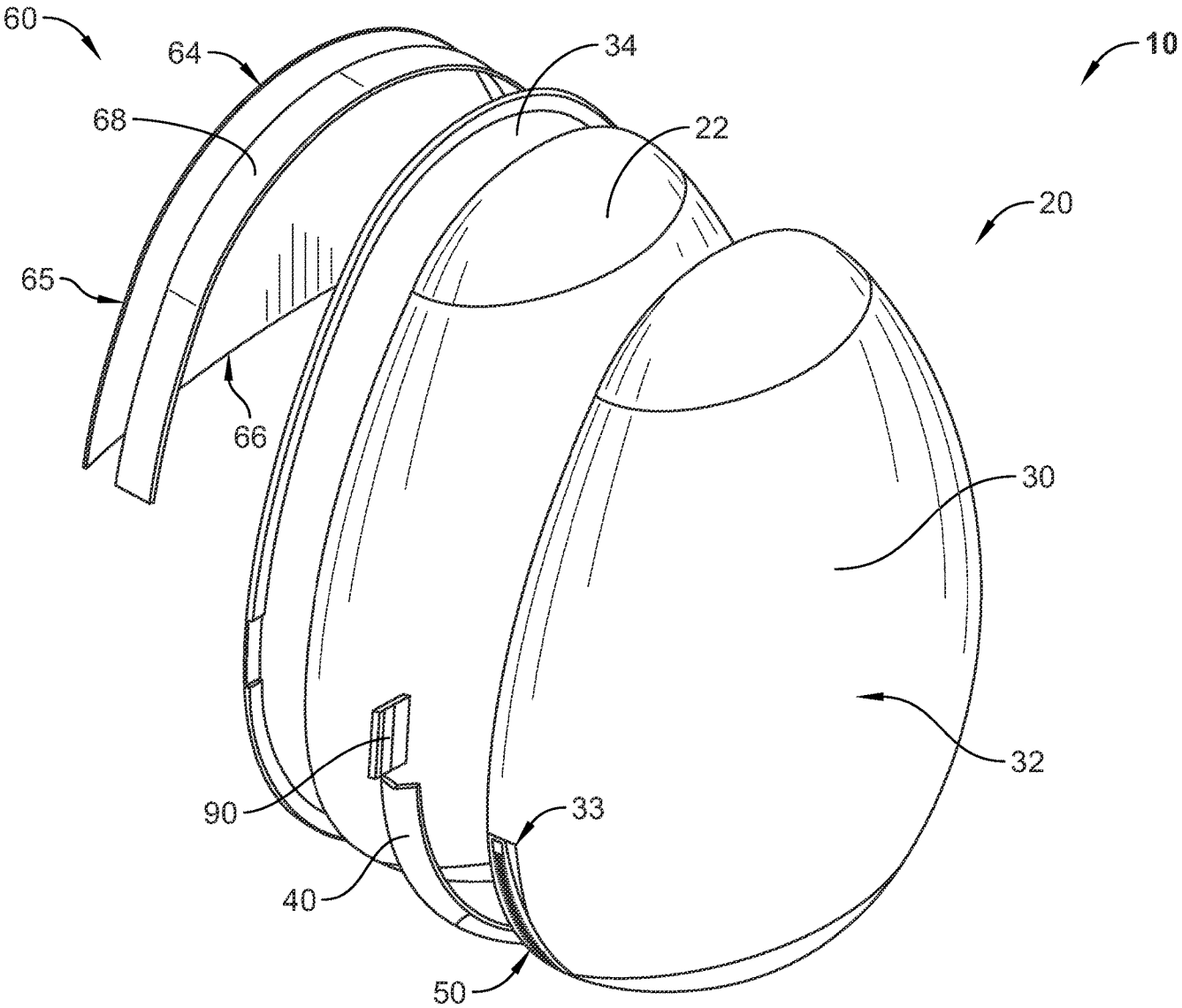
FIG. 6 is an exploded view of the cushion cover of the portable support cushion of FIG. 1A.
Figure 7B:
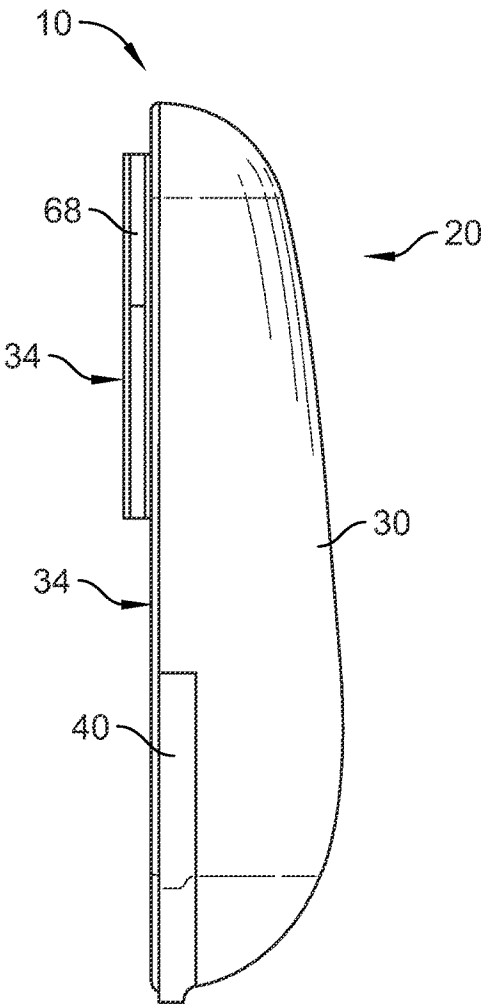
FIG. 7B is a side view of the portable support cushion of FIG. 1A showing the flap in a closed position covering the zipper of the cover.
Figure 7A:
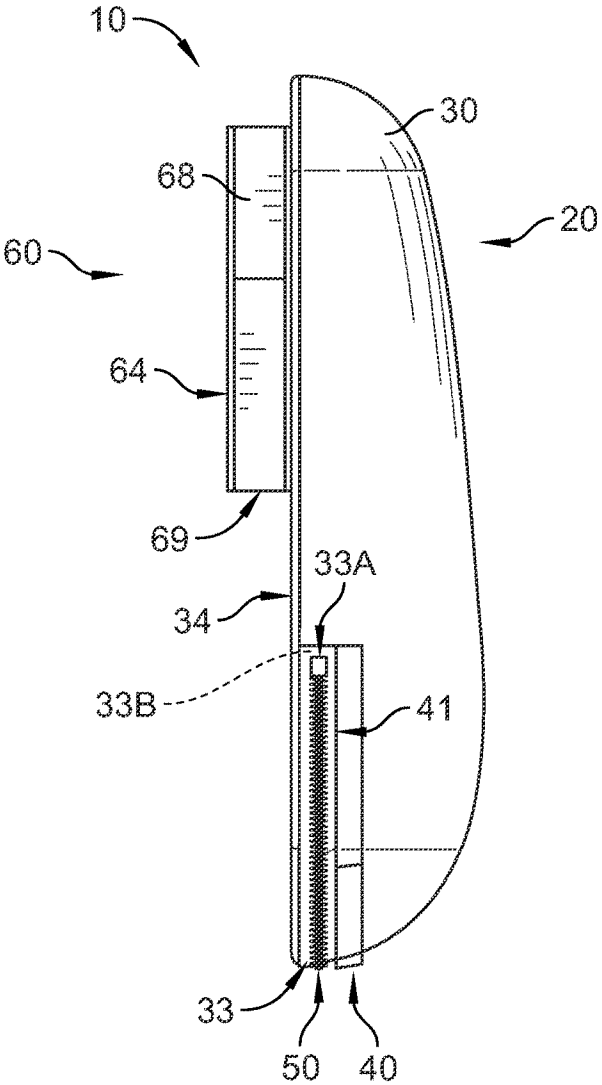
FIG. 7A is a side view of the portable support cushion of FIG. 1A showing the flap in an opened position exposing the zipper of the cover.

In some embodiments, the cover 30 includes an opening 31 formed on the bottom side 36 of the cover 30, as shown in FIGS. 6 and 7A. The opening 33 extends from a first terminal end 33A located on a first lateral side of the cushion cover 30 to a second terminal end 33B located on a second lateral side of the cushion cover 30 opposite the first lateral side. The opening 33 is sized to allow the cushion body 22 to be easily removed from and inserted into the cover 30. In certain embodiments, the opening 33 is selectively openable and closable via a zipper 50.

Illustratively, the cover 30 further includes a flap strip 40 that extends over an entirety of the opening 33 and the zipper 50, as shown in FIGS. 3B, 5A, 6, and 7B. A first longitudinal edge 41 of the flap strip 40 is formed as a hinge edge 41 that is directly attached to the cushion cover 30. A second longitudinal edge 43 of the flap strip 40 opposite the first longitudinal edge 41 is not attached to the cushion cover 30 so as to allow the flap strip 40 to pivot about the hinge edge 41 between an opened arrangement in which the zipper 50 is exposed to a surrounding environment, as shown in FIG. 7A, and a closed arrangement in which the zipper 50 is covered, as shown in FIG. 7B. In some embodiments, the flap strip 40 may include a plastic layer 42 between an inner portion 44 of the flap strip 40 that is folded over at the second longitudinal edge 43 and an outer portion 45 that extends between the first and second longitudinal edges 41, 42. The plastic layer 42 provides some rigidity such that the flap strip 40 remains in the opened and closed arrangements when moved to these arrangements by the user 200.

Figure 8:
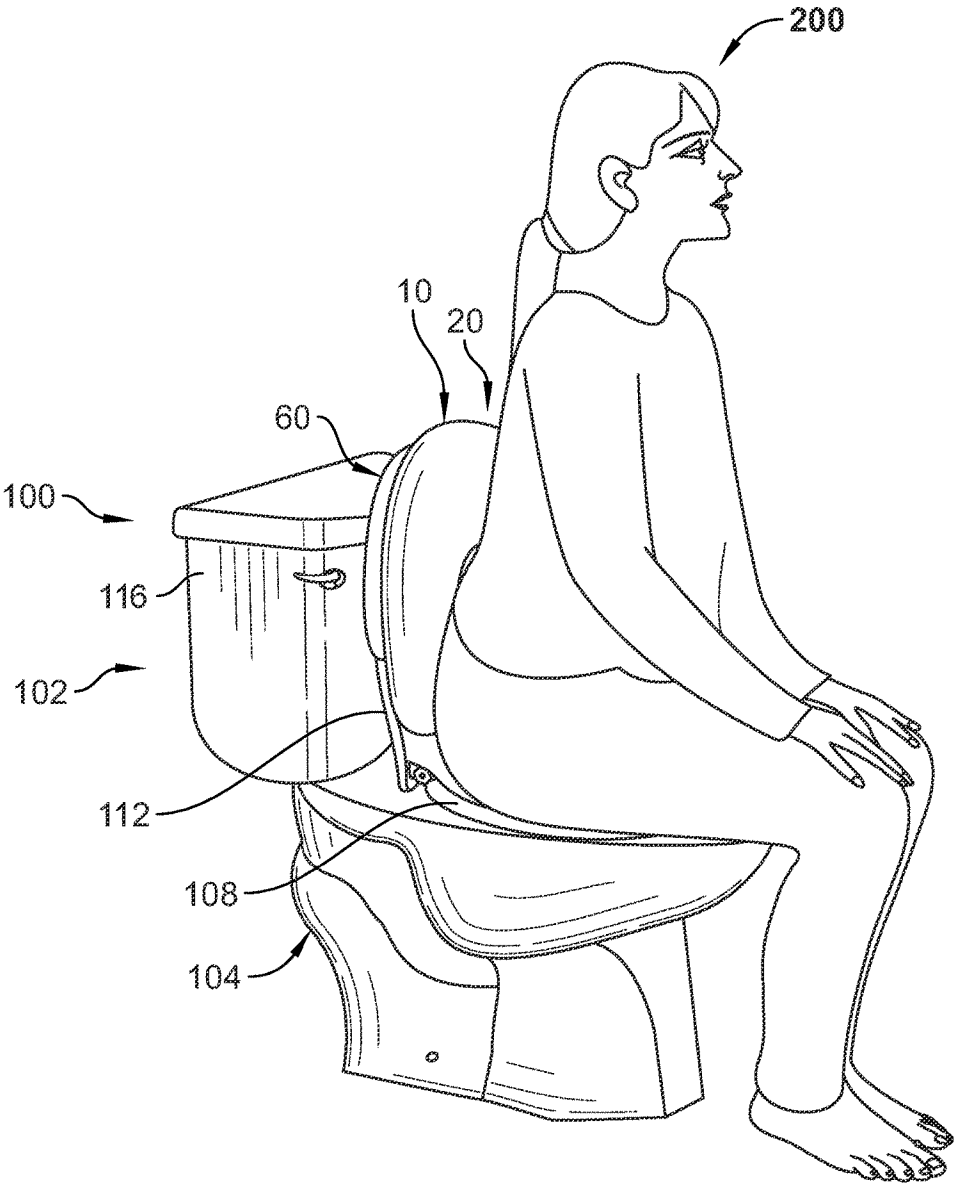
FIG. 8 is a perspective view of a first use arrangement of the portable support cushion of FIG. 1A.
Figure 10:
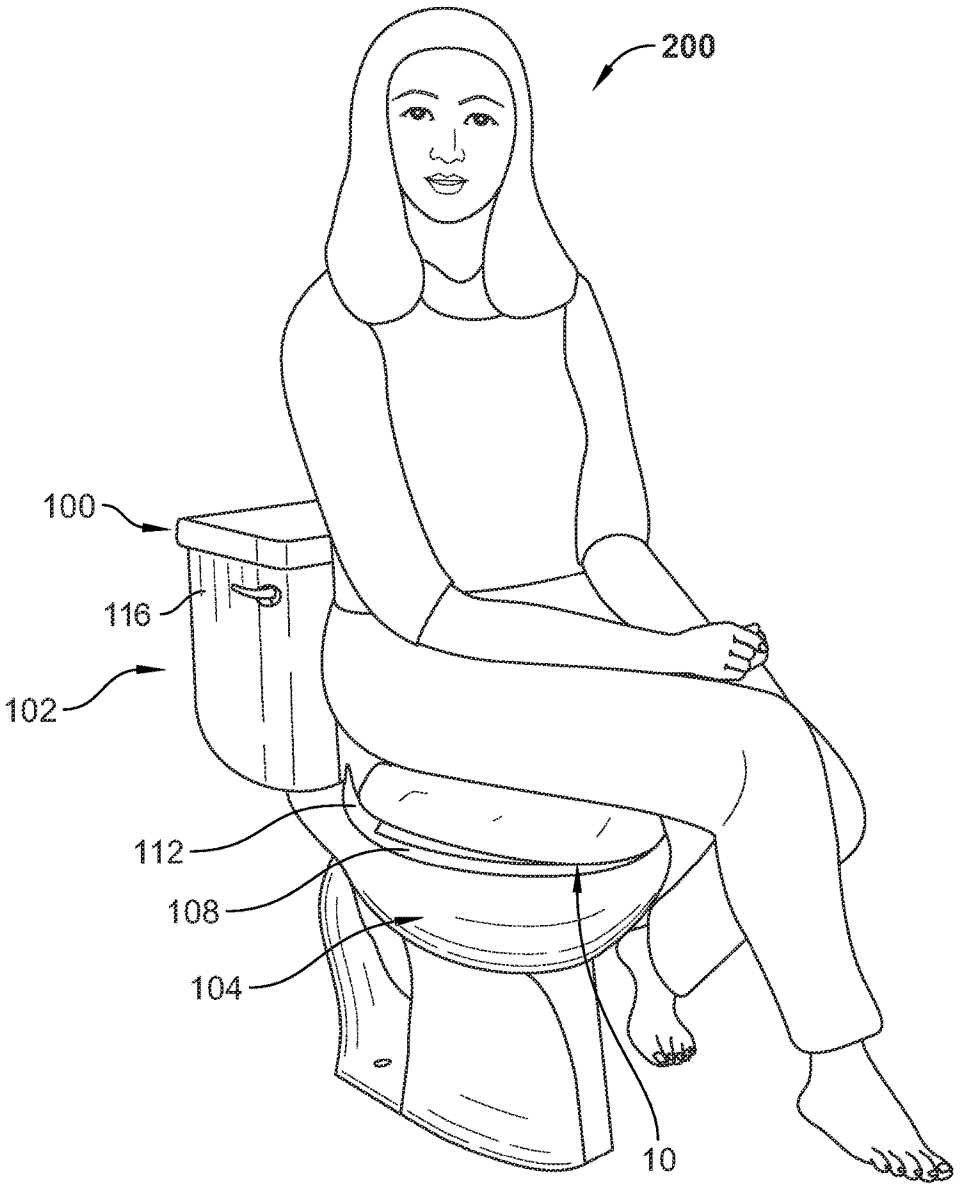
FIG. 10 is a perspective view of the second use arrangement of the portable support cushion of FIG. 9.
Figure 12:
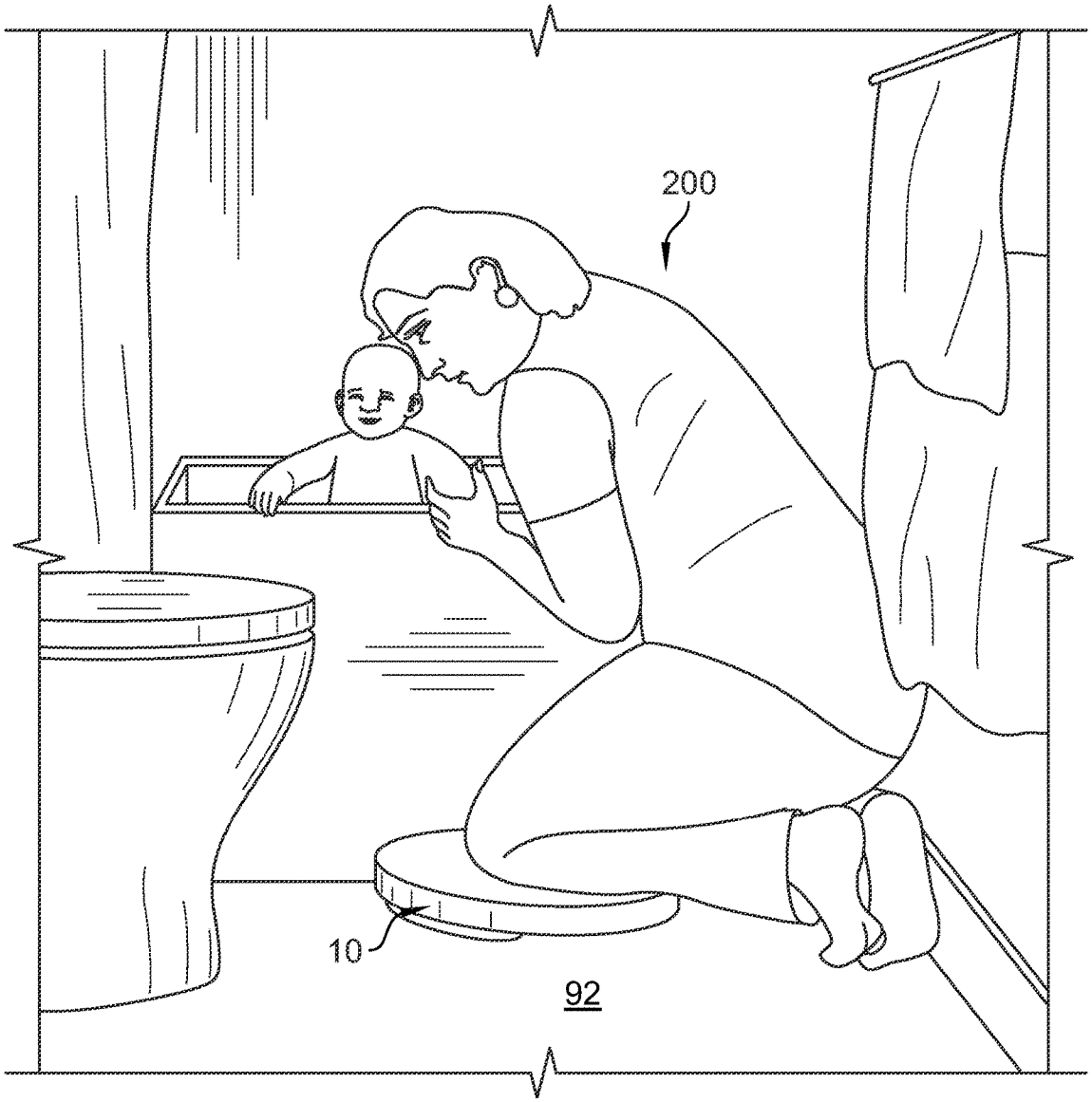
FIG. 12 is a perspective view of the third use arrangement of the portable support cushion of FIG. 11.

As shown in FIGS. 1A-2B, the portable support cushion 10 is mounted on the toilet seat lid 112 via the support pouch 60 arranged on the rear coves surface 34. The support pouch 60 is shown in greater detail in FIGS. 3A and 5B-7B. Illustratively, the support pouch 60 is changeable between an expanded arrangement, as shown in FIG. 7A, and a collapsed arrangement, as shown in FIG. 7B. As will be described in greater detail below, the expanded arrangement allows for attachment to the toilet seat lid 112 or other support surface, as shown in FIGS. 8 and 10, while the collapsed arrangement allows for usage on a horizontal support surface, such as a floor 92, as shown in FIG. 12.

To facilitate mounting strength with the support surface of toilet seat lid 112, the support pouch 60 may comprise elastic materials such as, for example, Electra Elastic fabric. The pouch 60 may also be treated with antimicrobials. The elastic material provides greater versatility for the pouch 60 to be attached to a number of different sizes and shapes of toilet lids 112 and support surfaces. Moreover, the elasticity provides enough strength to hold the support cushion 10 in place on the toilet seat lid 112. Moreover, the elasticity provides enough strength to hold the support cushion 10 in place while the user's 200 back moves up and down relative to the cushion 10. In the expanded arrangement, the support pouch 60 is configured to be stretched and arranged around at least a portion of the toilet seat lid 112 such that the elastic force of the elastic material causes the support pouch 60 to grasp the toilet seat lid 112 so as to mount the portable support cushion 10 on the toilet seat lid 112.

Figure 2B:
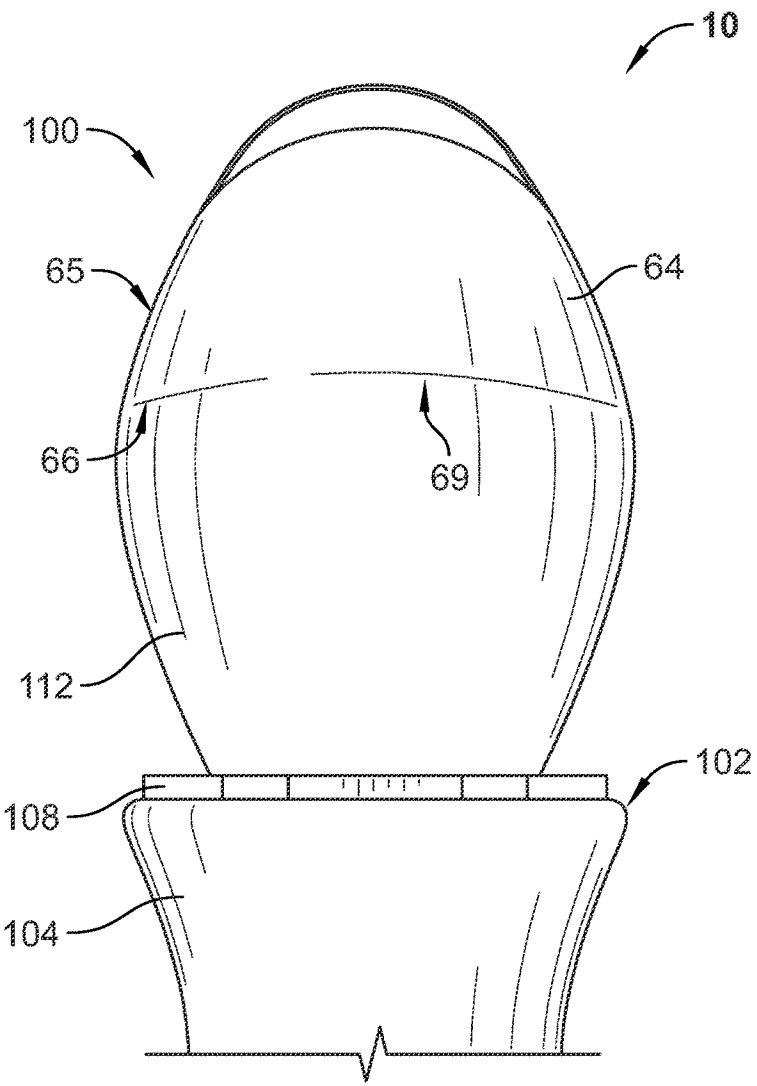
FIG. 2B is a rear view of the portable support cushion of FIG. 1A showing the cushion arranged on a toilet seat lid.
Figure 5B:
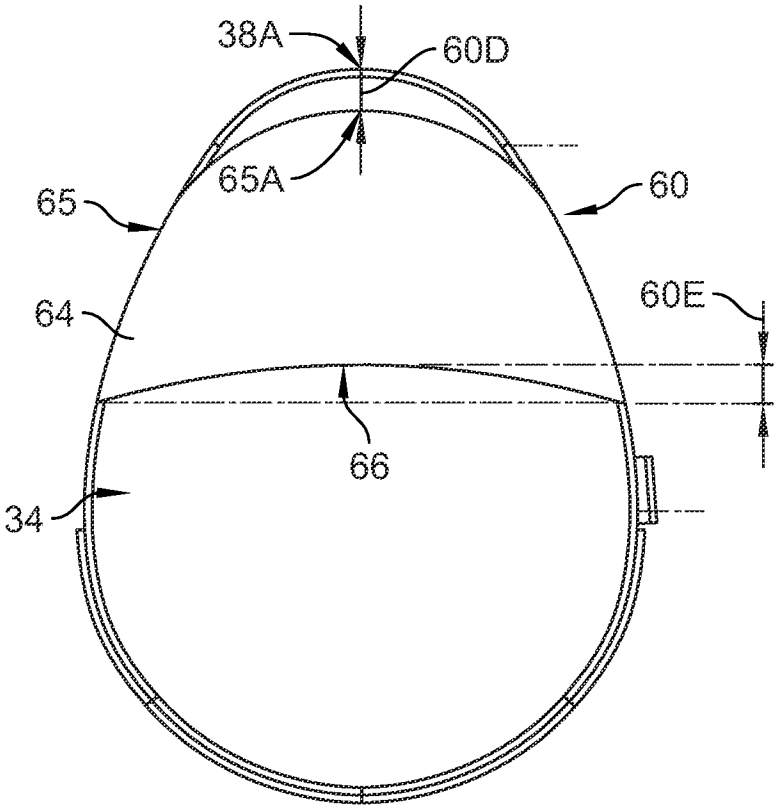
FIG. 5B is a rear view of the cushion cover of the portable support cushion of FIG. 1A.
Figure 5A:
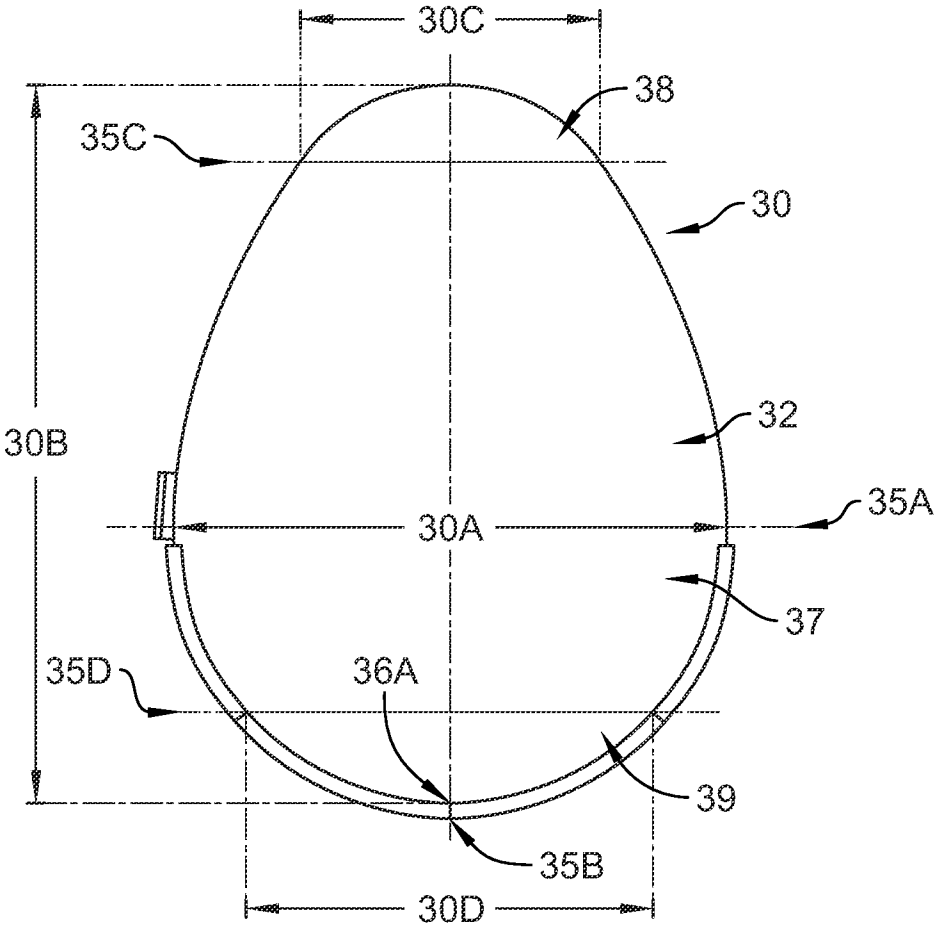
FIG. 5A is a front view of the cushion cover of the portable support cushion of FIG. 1A.
Figure 5D:
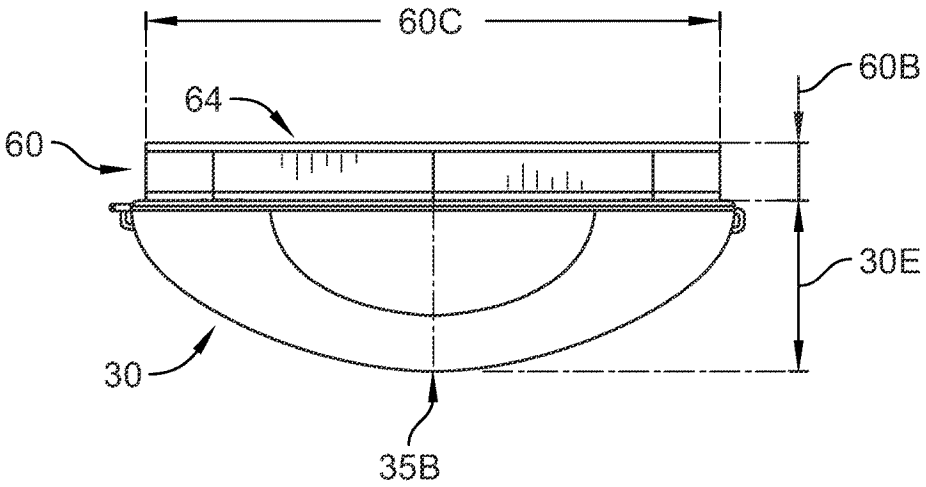
FIG. 5D is a top view of the cushion cover of the portable support cushion of FIG. 1A.

The support pouch 60 includes a rear wall 64 and a perimeter side wall 68 arranged to extend between and interconnect the rear wall 64 and the rear cover surface 34, as shown in detail in FIGS. 5B-6. An outer contour of the outer edge 65 of the rear wall 64 may be shaped to generally match the outer contour of the cover 30 (i.e. the egg-shaped contour). As shown in FIGS. 2B and 5B, the bottom edge 66 may include a slight curvature, which extends upwardly from its lower terminal end points by a distance 60E in a range of 20 mm to 30 mm, and in particular, approximately 24 mm. In other embodiments, the bottom edge 66 may be generally straight and level. The perimeter side wall 68 extends between the rear wall 64 and the rear cover surface 34. In some embodiments, the perimeter side wall 68 extends around the outer edge 65 but not across the bottom edge 66 so as to define a pouch cavity 67 between the rear wall 64, the perimeter side wall 68, and the rear cover surface 34. A pouch opening 69 is defined at the bottom edge 66 and opens into the pouch cavity 67.

Figure 2A:
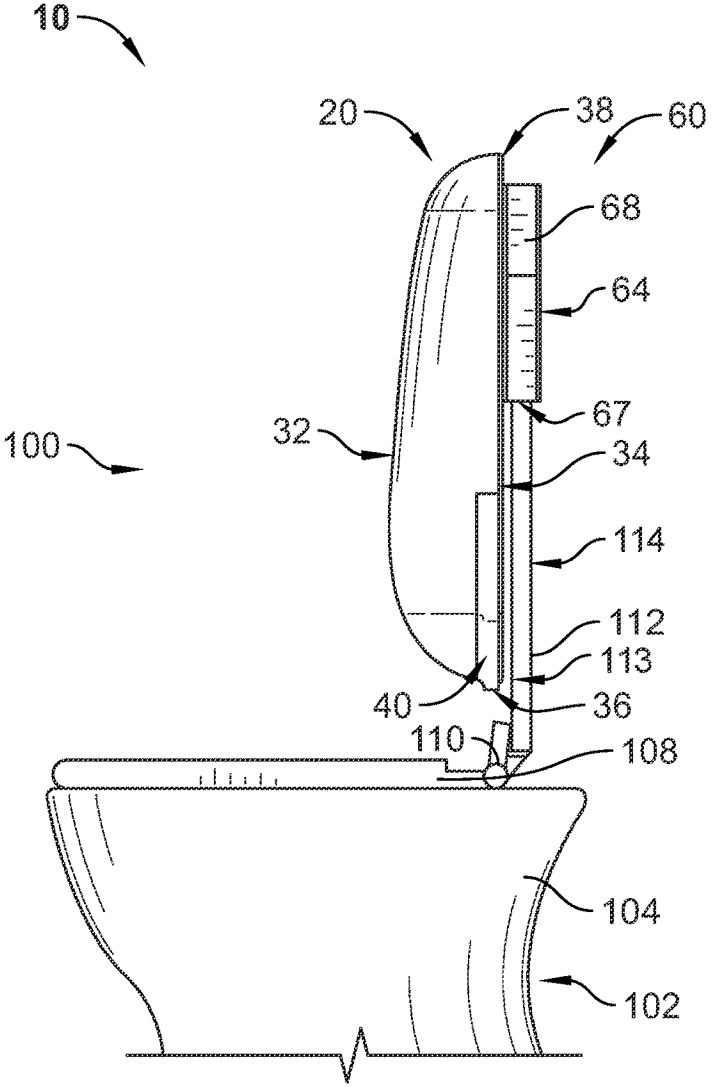
FIG. 2A is a side view of the portable support cushion of FIG. 1A to showing the cushion arranged on a toilet seat lid.

In the expanded arrangement, the toilet seat lid 112 extends through the pouch opening 59 and into the pouch cavity 67 when the portable support cushion 10 is mounted on the toilet seat lid 112, as shown, for example, in FIG. 2A. Moreover, in the expanded arrangement, an inner top portion of the perimeter side wall 68 is arranged on and rests on a top side of the toilet seat lid 112 when the support cushion 10 is mounted on the toilet seat lid 112, thus aiding in supporting the support cushion 10 on the lid 112. Additionally, in the expanded arrangement, the rear wall 64 is arranged on one of the top and bottom surfaces 113, 114 of the toilet seat lid 112 and the rear cover surface 34 is arranged on the other of the top and bottom surfaces 113, 114 when the support cushion 10 is mounted on the toilet seat lid 112. For example, when the support cushion 10 is mounted for back support as shown in FIG. 8, the rear wall 64 is arranged on the top surface 113 and the rear cover surface 34 is arranged on the bottom surface 114. Conversely, when the support cushion 10 is mounted for bottom support as shown in FIG. 10, the rear wall 64 is arranged on the bottom surface 114 and the rear cover surface 34 is arranged on the top surface 113.

As can be seen in FIGS. 2B and 5B, the support pouch 60 is positioned on the cushion cover 30 such that a bottommost end (see 36*a* in FIG. 5A) of the cushion cover 30 (and thus the cushion body 22 as well) is spaced apart from a bottommost terminal end of the toilet seat lid 112 when the lid 112 is in the raised position. In this way, the support cushion 110 does not touch the toilet seat 108, thus significantly preventing any undesirable substances or particles front contacting the support cushion 10. In some embodiments, the topmost point 65A of the pouch 60 is spaced apart from a topmost point 38A of the cover 30 by a distance 60D in a range of 20 mm to 30 mm, and in particular, approximately 25 mm. A person skilled in the art will understand that this distance may be adjusted based on the sizing requirements of the cushion 10. In some embodiments, the support pouch 60 is arranged on a top half of the rear cover surface 34 such that a bottom half of the rear cover surface 34 is configured to contact the toilet seat lid 112.

In the expanded arrangement, the rear wall 64 of the support pouch is spaced apart from the rear cover surface 34 so as to define the pouch cavity 67, and, in the collapsed arrangement, the perimeter side wall 68 is collapsed such that the rear wall 64 is located adjacent to the rear cover surface 34, as shown in FIGS. 7A and 7B. In some embodiments, the rear wall 64 is generally parallel with the rear cover surface 34 so as to form a tight fit with the generally planar toilet seat lid 112.

Figure 5E:
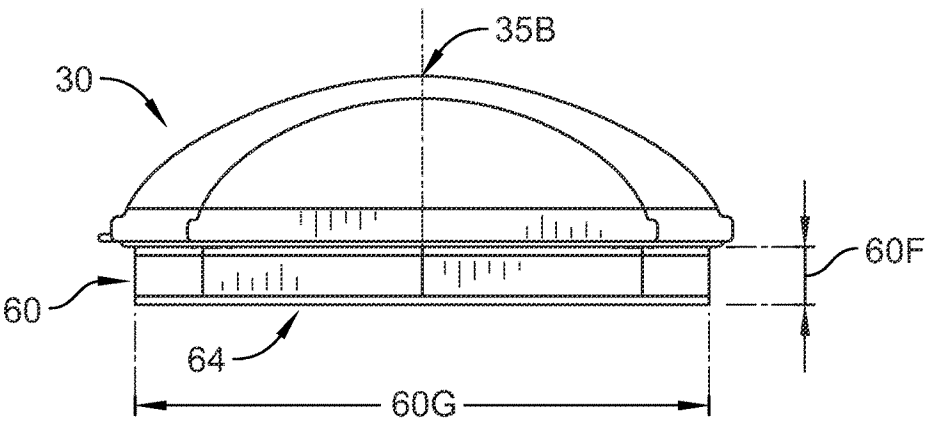
FIG. 5E is a bottom view of the cushion cover of the portable support cushion of FIG. 1A.
Figure 5C:
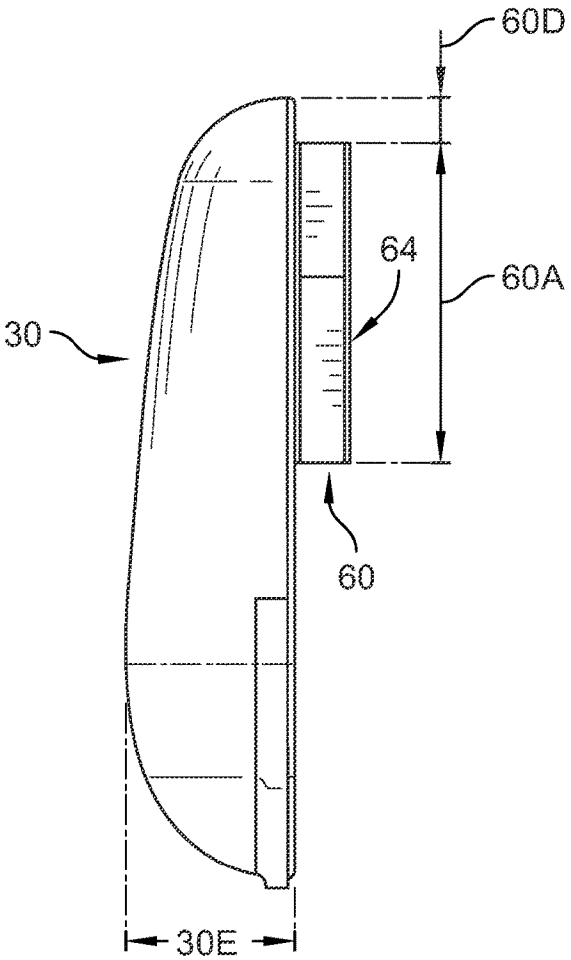
FIG. 5C is a side view of the cushion cover of the portable support cushion of FIG. 1A.

FIGS. 5B-5E show a non-limiting example of a configuration of the support pouch 60. In some embodiments, the support pouch 60 may include dimensions that provide good versatility for use with various toilet seat lid 112 shapes and sizes. As particularly applicable to the cushion body 22 and cover 30 described above, the support pouch 60 may include a pouch height 60A in a range of 150 mm to 200 mm, or in a range of 170 mm to 180 mm, or, in particular, approximately 177 mm. The support pouch 60 may include a depth 60B in a range of 20 mm to 40 mm, or in a range of 25 mm to 35 mm, or, in particular, approximately 30 mm. The support pouch 60 may include a width 60C in a range of 300 mm to 340 mm, or in a range of 310 mm to 320 mm, or, in particular, approximately 317 mm. As shown in FIG. 5E, The opening 69 may include a depth 60F that is slightly smaller than the depth 60B of the outside of the pouch 60 itself, in particular approximately 4 mm to 8 mm smaller than the depth 60B, or, in particular, approximately 26 mm. Likewise, the opening 69 may include a width 60G that is slightly smaller than the width 60C of the outside of the pouch 60 itself, in particular approximately 4 mm to 8 mm smaller than the width 60C, or, in particular, approximately 313 mm.

As shown in FIGS. 1B-2B and 8, in a first use arrangement, the support pouch 60 is arranged on the top side of the toilet seat lid 112 when the toilet seat lid 112 is in a raised position away from the toilet seat 108 such that the cushion body assembly 20 is arranged on the bottom surface 114 of the toilet seat lid 112. As such the cushion body 22 and cover 30 are aligned with and contact a lumbar region of the user 200 so as to allow the user 200 to lean back on the portable support cushion 10.

Figure 9:
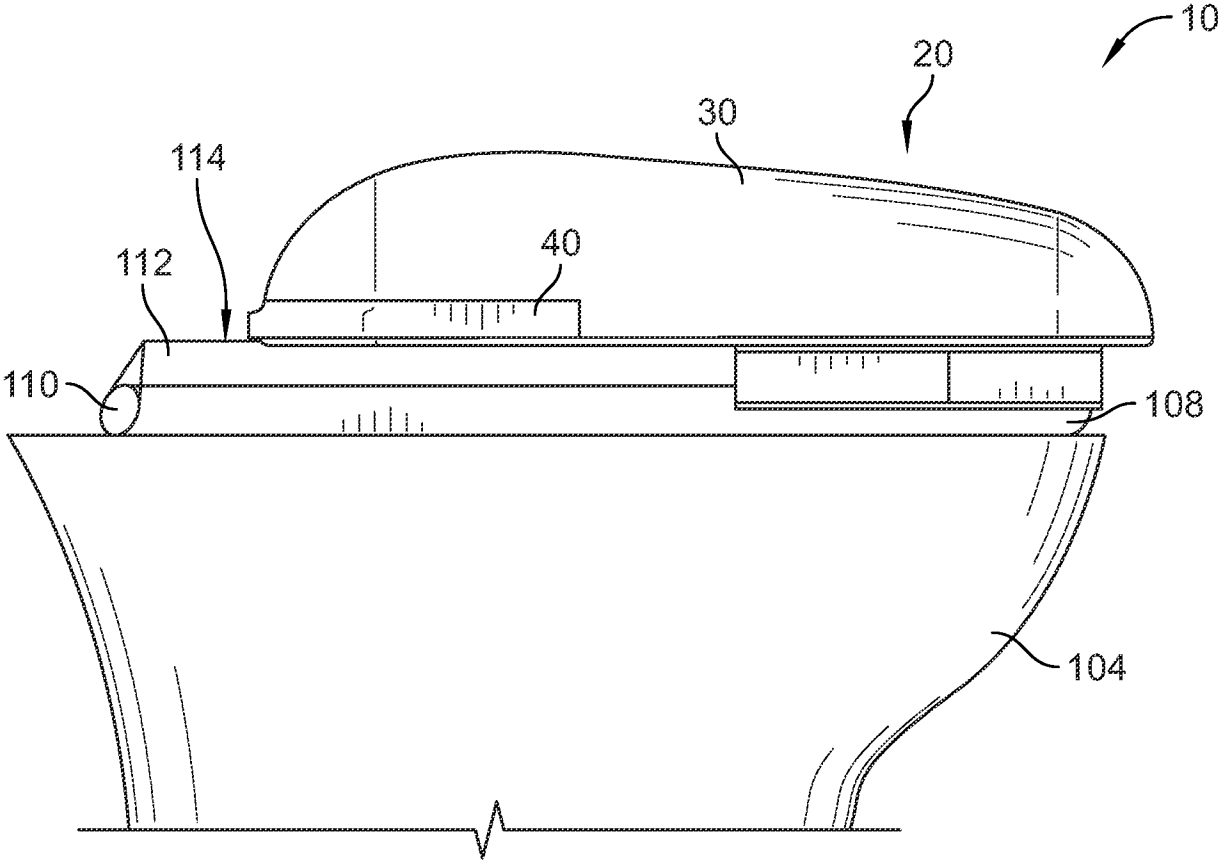
FIG. 9 is a side view of a second use arrangement of the portable support cushion of FIG. 1A.

As shown in FIGS. 9 and 10, in a second use arrangement, the support pouch 60 is arranged on the top side of the toilet seat lid 112 when the toilet seat lid 112 is in the lowered position against the toilet seat 108 such that the cushion body assembly 20 is arranged on the top surface 113 of the toilet seat lid 112. As such the cushion body 22 and cover 30 are aligned with and contact an underside of an upper leg region of the user 200 so as to allow the user 200 to sit on the portable support cushion 10.

Figure 11:
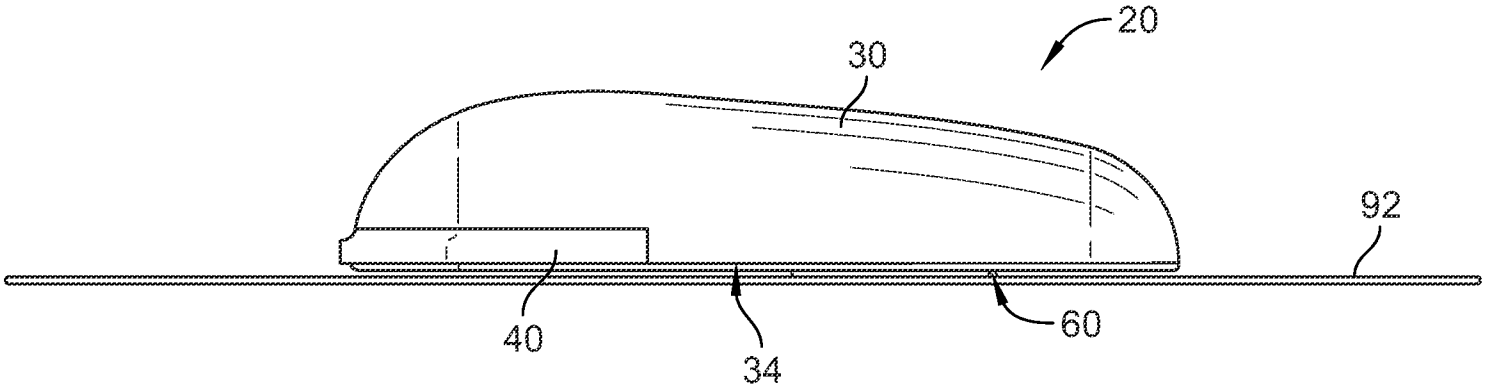
FIG. 11 is a side view of a third use arrangement of the portable support cushion of FIG. 1A.

As shown in FIGS. 11 and 12, in a third use arrangement, the support pouch 10 is arranged in the collapsed arrangement such that the rear wall 64 of the support pouch 60 is substantially aligned with the rear cover surface 34 so as to allow the portable support cushion 10 to rest on a flat surface, such as a floor 92, on the rear cover surface 34 such that the user 200 can rest on the portable support cushion 10. For example, the user 200 can place the support cushion 10 on the floor 92 beside a bathtub and rest his or her knees on the support cushion 10.

A person skilled in the art will understand that the use arrangements described herein are merely exemplary and do not represent all potential uses and arrangements of the described support cushion 10. A skilled artisan will understand that the support cushion 10 may be utilized on various surfaces around the household or in other settings, especially due to the portability of the support cushion 10. For example, the support cushion 10 may be utilized on other seat devices and chairs, in vehicles, as well as on any floor or flat surface requiring enhanced comfort.

Figure 13:
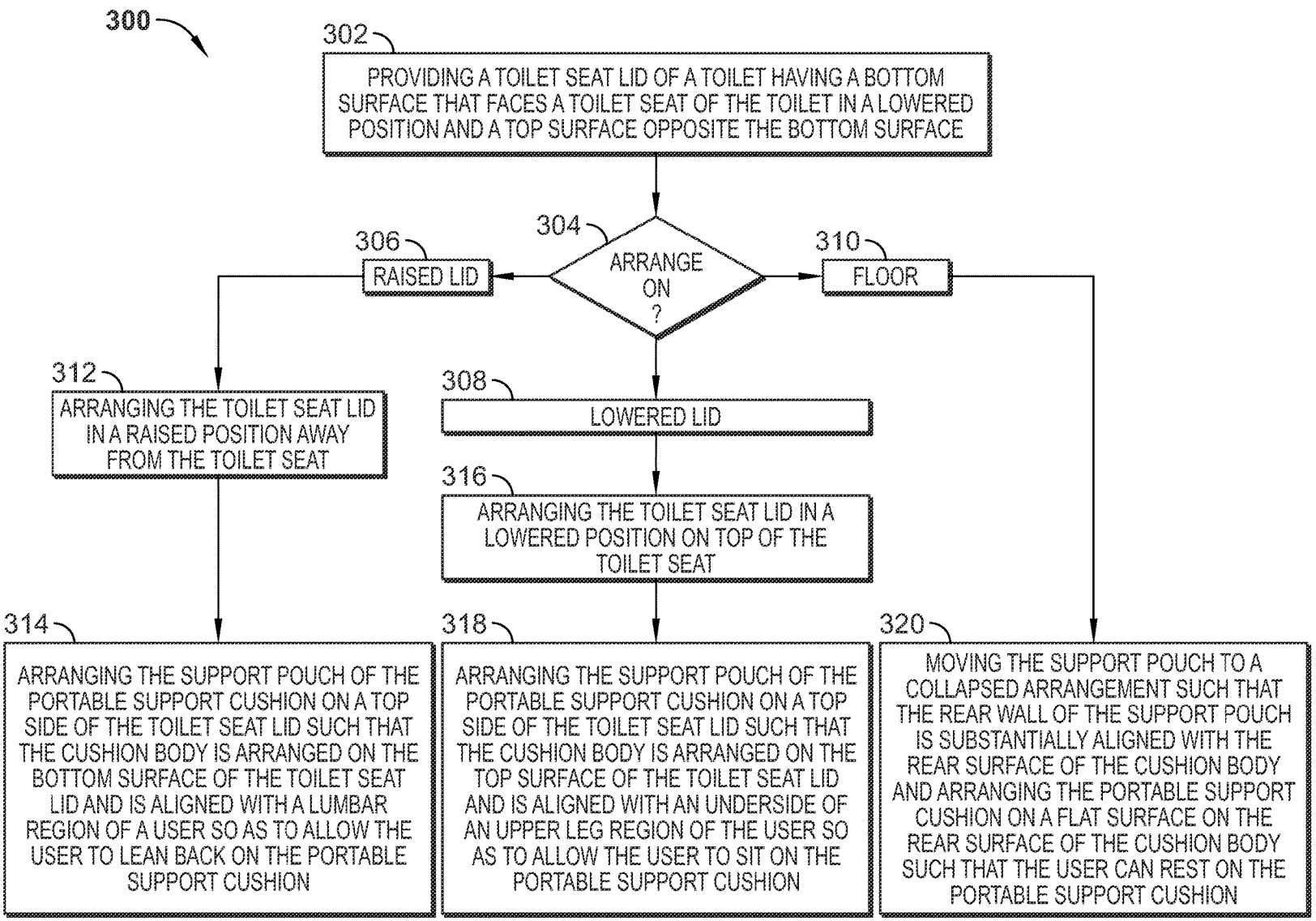
FIG. 13 is a flow diagram showing methods of use of the portable support cushion of FIG. 1A.

FIG. 13 shows a flow diagram of potential methods of use of the support cushion 10 described above, in particular a method 300. The method 300 may include a first operational step 302 of providing the support cushion 10 described above. In a second operational step 304, a decision may be made as to what surface the support cushion 10 will be arranged on, for example, on a raised toilet lid 112 (shown as operational sub-step 306), on a lowered toilet lid 112 (shown as operational sub-step 308), or on a floor 92 (shown as operational sub-step 310). In a third operational step 312, after having decided to arrange the support cushion 10 on a toilet lid 112 in the raised position, the toilet seat lid 112 is arranged in the raised position away from the toilet seat 108. The method 300 proceeds to operational step 314, which includes arranging the support pouch 60 of the portable support cushion 10 on a top side of the toilet seat lid 112 such that the cushion body assembly 20 is arranged on the bottom surface 114 of the toilet seat lid 112 and is aligned with a lumbar region of the user 200.

In a fourth operational step 316, after having decided to arrange the support cushion 10 on a toilet lid 112 in the lowered position, the toilet seat lid 112 is arranged in the lowered position on top of the toilet seat 108. The method 300 proceeds to operational step 318, which includes arranging the support pouch 60 on the top side of the toilet seat lid 112 such that the cushion both assembly 20 is arranged on the top surface 113 of the toilet seat lid 112 and is aligned with an underside of an upper leg region of the user 200.

Finally, after having decided to arrange the support cushion 10 on a floor 92, a fifth operational step 320 may include removing the support pouch 60 from the top side of the toilet seat lid 112 so as to remove the portable support cushion 10 from the toilet seat lid 112, moving the support pouch 60 to the collapsed arrangement described above such that the rear wall 64 is substantially aligned with a rear cover surface 34, or with the cushion body 22, and arranging the portable support cushion 10 on a flat surface or floor 92 on the rear cover surface 34.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present disclosure and fall within the spirit and scope of the present disclosure as defined by the appended claims.

The features illustrated or described in connection with one exemplary embodiment may be combined with any other feature or element of any other embodiment described herein. Such modifications and variations are intended to be included within the scope of the present disclosure. Further, a person skilled in the an will recognize that terms commonly known to those skilled in the art may be used interchangeably herein.

As used herein, an element or step recited in the singular and proceeded with the word "a" or "an" should be understood as not excluding plural of said elements or steps, unless such exclusion is explicitly stated. Furthermore, references to "one embodiment" of the presently described subject matter are not intended to be interpreted as excluding the existence of additional embodiments that also incorporate the recited features. Specified numerical ranges of units, measurements, and/or values comprise, consist essentially or, or consist of all the numerical values, units, measurements, and/or ranges including or within those ranges and/or endpoints, whether those numerical values, units, measurements, and/or ranges are explicitly specified in the present disclosure or not.

Unless defined otherwise, technical and scientific terms used herein have the same meaning as is commonly understood by one of ordinary skill in the art to which this disclosure belongs. The terms "first," "second," "third" and the like, as used herein do not denote any order or importance, but rather are used to distinguish one element from another. The term "or" is meant to be inclusive and mean either or all of the listed items. In addition, the terms "connected" and "coupled" are not restricted to physical or mechanical connections or couplings, and can include electrical connections or couplings, whether direct or indirect.

Moreover, unless explicitly stated to the contrary, embodiments "comprising," "including," or "having" an element or a plurality of elements having a particular property may include additional such elements not having that property. The term "comprising" or "comprises" refers to a composition, compound, formulation, or method that is inclusive and does not exclude additional elements, components, and/or method steps. The term "comprising" also refers to a composition, compound, formulation, or method embodiment of the present disclosure that is inclusive and does not exclude additional elements, components, or method steps.

The phrase "consisting of" or "consists of" refers to a compound, composition, formulation, or method that excludes the presence of any additional elements, components, or method steps. The term "consisting of" also refers to a compound, composition, formulation, or method of the present disclosure, that excludes the presence of any additional elements, components, or method steps.

The phrase "consisting essentially of" or "consists essentially of" refers to a composition, compound, formulation, or method that is inclusive of additional elements, components, or method steps that do not materially affect the characteristic(s) of the composition, compound, formulation, or method. The phrase "consisting essentially of" also refers to a composition, compound, formulation, or method of the present disclosure that is inclusive of additional elements, components, or method steps that do not materially affect the characteristic(s) of the composition, compound, formulation, or method steps.

Approximating language, as used herein throughout the specification and claims, may be applied to modify any quantitative representation that could permissibly vary without resulting in a change in the basic function to which it is related. Accordingly, a value modified by a term or terms, such as "about," and "substantially" is not to be limited to the precise value specified. In some instances, the approximating language may correspond to the precision of an instrument for measuring the value. Here and throughout the specification and claims, range limitations may be combined and/or interchanged. Such ranges are identified and include all the sub-ranges contained therein unless context or language indicates otherwise.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances, the modified term may sometimes not be appropriate, capable, or suitable.

It is to be understood that the above description is intended to be illustrative, and not restrictive. For example, the above-described embodiments (and/or aspects thereof) may be used individually, together, or in combination with each other. In addition, many modifications may be made to adapt a particular situation or material to the teachings of the subject matter set forth herein without departing from its scope. While the dimensions and types of materials described herein are intended to define the parameters of the disclosed subject matter, they are by no means limiting and are exemplary embodiments. Many other embodiments will be apparent to those of skill in the art upon reviewing the above description. The scope of the subject matter described herein should, therefore, be determined with reference to the appended claims, along with the full scope of equivalents to which such claims are entitled.

This written description uses examples to disclose several embodiments of the subject matter set forth herein, including the best mode, and also to enable a person of ordinary skill in the art to practice the embodiments of disclosed subject matter, including making and using the devices or systems and performing the methods. The patentable scope of the subject matter described herein is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The following numbered clauses include embodiments that are contemplated and non-limiting.

Clause 1. A toilet system comprising a toilet including a bowl, a toilet seat pivotably arranged on a top rim of the bowl, and a toilet seat lid pivotably arranged above the toilet seat the toilet seat lid including a bottom surface that faces the toilet seat in a lowered position when the toilet seat lid is resting on top of the toilet seat and a top surface opposite the bottom surface.

Clause 2. The toilet system of clause 1, any other clause, or combination of clauses, further comprising a portable support cushion including a cushion body including a front body surface configured to engage a body of a user and a rear body surface arranged to face opposite the front body surface, and a cushion cover surrounding the cushion body so as to enclose the cushion body therein, the cushion cover including a front cover surface adjacent the front body surface and a rear cover surface adjacent the rear body surface.

Clause 3. The toilet system of clause 2, any other clause, or combination of clauses, further comprising a support pouch coupled to the rear cover surface and changeable between an expanded arrangement and a collapsed arrangement, the support pouch comprising an elastic material, wherein, in the expanded arrangement, the support pouch is configured to be stretched and arranged around at least a portion of the toilet seat lid such that elastic force of the elastic material causes the support pouch to grasp the toilet seat lid so as to mount the portable support cushion on the toilet seat lid.

Clause 4. The toilet system of clause 3, any other clause, or combination of clauses, wherein, in the expanded arrangement, the support pouch is formed to include a pouch cavity and a pouch opening arranged to open into the pouch cavity, and wherein, in the expanded arrangement, the toilet seat lid extends through the pouch opening and into the pouch cavity when the portable support cushion is mounted on the toilet seat lid.

Clause 5. The toilet system of clause 4, any other clause, or combination of clauses, wherein the support pouch includes a rear wall and a perimeter side wall arranged to extend between and interconnect the rear wall and the rear cover surface, wherein the pouch cavity is defined, at least in part, to be between the rear wall, the perimeter side wall, and the rear cover surface, and wherein, in the expanded arrangement, the rear wall is arranged on one of the bottom and top surface of the toilet seat lid and the rear cover surface is arranged on the other of the bottom and top surface of the toilet seat lid when the portable support cushion is mounted on the toilet seat lid.

Clause 6. The toilet system of clause 5, any other clause, or combination of clauses, wherein in the expanded arrangement, the rear wall of the support pouch is spaced apart from the rear cover surface so as to define the pouch cavity, and, in the collapsed arrangement, the perimeter side wall is collapsed such that the rear wall is located adjacent to the rear cover surface.

Clause 7. The toilet system of clause 6, any other clause, or combination of clauses, wherein in the expanded arrangement, an inner top portion of the perimeter side wall of the support pouch is arranged on a to side of the toilet seat lid when the portable support cushion is mounted on the toilet seat lid, and wherein the support pouch is positioned on the cushion cover such that a bottommost end of the cushion body and the cushion cover is spaced apart from a bottommost terminal end of the toilet seat lid closest to the toilet seat.

Clause 8. The toilet system of clause 6, any other clause, or combination of clauses, wherein the support pouch is arranged on a top half of the rear cover surface such that a bottom half of the rear cover surface is configured to contact the toilet seat lid, and wherein the rear wall is generally parallel with the rear cover surface.

Clause 9. The toilet system of clause 3, any other clause, or combination of clauses, wherein, in a first use arrangement, the support pouch is arranged on the top side of the toilet seat lid when the toilet seat lid is in a raised position away from the toilet seat such that the cushion body is arranged on the bottom surface of the toilet seat lid.

Clause 10. The toilet system of clause 3, any other clause, or combination of clauses, wherein, in a second use arrangement, the support pouch is arranged on the top side of the toilet seat lid when the toilet seat lid is in the lowered position such that the cushion body is arranged on the top surface of the toilet seat lid.

Clause 11. The toilet system of clause 3, any other clause, or combination of clauses, wherein, in a third use arrangement, the support pouch is arranged in the collapsed arrangement such that a rear wall of the support pouch is substantially aligned with the rear cover surface so as to allow the portable support cushion to rest on a flat surface on the rear cover surface such that a user can rest on the portable support cushion.

Clause 12. A portable support cushion comprising a cushion body including a front body surface configured to engage a body of a user and a rear body surface arranged to face opposite the front body surface, and a cushion cover surrounding the cushion body so as to enclose the cushion body therein, the cushion cover including a front cover surface adjacent the front body surface and a rear cover surface adjacent the rear body surface.

Clause 13. The portable support cushion of clause 12, any other clause, or combination of clauses, wherein a support pouch coupled to the rear cover surface and changeable between an expanded arrangement and a collapsed arrangement, the support pouch comprising an elastic material, wherein, in the expanded arrangement, the support pouch is configured to be stretched and arranged around at least a portion of a cushion support such that elastic force of the elastic material causes the support pouch to grasp the cushion support so as to mount the portable support cushion on the cushion support.

Clause 14. The portable support cushion of clause 13, any other clause, or combination of clauses, wherein, in the expanded arrangement, the support pouch is formed to include a pouch cavity and a pouch opening arranged to open into the pouch cavity, and wherein, in the expanded arrangement, the cushion support extends through the pouch opening and into the pouch cavity when the portable support cushion is mounted on the cushion support.

Clause 15. The portable support cushion of clause 14, any other clause, or combination of clauses, wherein the support pouch includes a rear wall and a perimeter side wall extending between and interconnecting the rear wall and the rear cover surface, wherein the pouch cavity is defined between the rear wall, the perimeter side wall, and the rear cover surface, wherein, in the expanded arrangement, the rear wall is arranged on a first support surface of the cushion support and the rear cover surface is arranged on a second support surface of the cushion support opposite the first support surface in the expanded arrangement when the portable support cushion is mounted on the cushion support, and wherein, in the expanded arrangement, the rear wall of the support pouch is spaced apart from the rear cover surface so as to define the pouch cavity, and, in the collapsed arrangement, the perimeter side wall is collapsed such that the rear wall is located adjacent to the rear cover surface.

Clause 16. The portable support cushion of clause 15, any other clause, or combination of clauses, wherein, in the expanded arrangement, an inner top portion of the perimeter side wall of the support pouch is arranged on a top end of the cushion support when the portable support cushion is mounted on the cushion support, and wherein the support pouch is positioned on the cushion cover such that a bottommost end of the cushion body and the cushion cover is spaced apart from a bottommost terminal end of the cushion support.

Clause 17. The portable support cushion of clause 15, any other clause, or combination of clauses, wherein the support pouch is arranged on a top half of the rear cover surface such that a bottom half of the rear cover surface is configured to contact the cushion support, and wherein the rear wall is generally parallel with the rear cover surface.

Clause 18. The portable support cushion of clause 13, any other clause, or combination of clauses, wherein the cushion cover includes an opening on a bottommost side of the cushion cover that is selectively openable and closable via a zipper, the opening configured to allow the cushion body to be removed from the cushion cover when the opening is opened via the zipper.

Clause 19. The portable support cushion of clause 18, any other clause, or combination of clauses, wherein the cushion cover further includes a flap strip that extends over an entirety of the opening and the zipper, wherein the opening extends from a first terminal end located on a first lateral side of the cushion cover to a second terminal end located on a second lateral side of the cushion cover opposite the first lateral side, and wherein the flap strip extends from the first terminal end to the second terminal end of the opening.

Clause 20. The portable support cushion of clause 19, any other clause, or combination of clauses, wherein a first longitudinal edge of the flap strip is a hinge edge that is attached to the cushion cover, and wherein a second longitudinal edge of the flap strip opposite the first longitudinal edge is not attached to the cushion cover so as to allow the flap strip to pivot about the hinge edge between an opened arrangement in which the zipper is exposed to a surrounding environment and a closed arrangement in which the zipper is covered.

Clause 21. A method of using a portable support cushion comprising providing a toilet seat lid of a toilet having a bottom surface that faces a toilet seat of the toilet in a lowered position and a top surface opposite the bottom surface, arranging the toilet seat lid in a raised position away from the toilet seat, and arranging a support pouch of the portable support cushion that is arranged on a rear side of a cushion body of the portable support cushion on a top side of the toilet seat lid such that the cushion body is arranged on the bottom surface of the toilet seat lid and is aligned with a lumbar region of a user so as to allow the user to lean back on the portable support cushion.

Clause 22. The method of clause 21, any other clause, or combination of clauses, further comprising stretching the support pouch, which is comprised of an elastic material, prior to arranging the support pouch on the top side of the toilet seat lid and, in the arranging step, fitting the stretched support pouch on the top side of the toilet seat lid such that elastic force of the elastic material causes the support pouch to securely grasp the cushion support so as to securely mount the portable support cushion on the cushion support.

Clause 23. The method of clause 22, any other clause, or combination of clauses, further comprising removing the support pouch from the top side of the toilet seat lid so as to remove the portable support cushion from the toilet seat lid, moving the toilet seat lid to the lowered position, and arranging the support pouch on the top side of the toilet seat lid such that the cushion body is arranged on the top surface of the toilet seat lid and is aligned with an underside of an upper leg region of the user so as to allow the user to sit on the portable support cushion.

Clause 24. The method of clause 22, any other clause, or combination of clauses, further comprising removing the support pouch from the top side of the toilet seat lid so as to remove the portable support cushion from the toilet seat lid, moving the support pouch to a collapsed arrangement such that a rear wall of the support pouch is substantially aligned with a rear surface of the cushion body, and arranging the portable support cushion on a flat surface on the rear surface of the cushion body such that the user can rest on the portable support cushion.

Clause 25. A method of using a portable support cushion comprising providing a toilet seat lid of a toilet having a bottom surface that faces a toilet seat of the toilet in a lowered position and a top surface opposite the bottom surface, arranging the toilet seat lid in the lowered position, and arranging a support pouch of the portable support cushion that is arranged on a rear side of a cushion body of the portable support cushion on a top side of the toilet seat lid such that the cushion body is arranged on the top surface of the toilet seat lid and is aligned with an underside of an upper leg region of the user so as to allow the user to sit on the portable support cushion.

Clause 26. The method of clause 25, any other clause, or combination of clauses, further comprising removing the support pouch from the top side of the toilet seat lid so as to remove the portable support cushion from the toilet seat lid, moving the toilet seat lid to a raised position away from the toilet seat, and arranging the support pouch on the top side of the toilet seat lid such that the cushion body is arranged on the bottom surface of the toilet seat lid and is aligned with a lumbar region of a user so as to allow the user to lean back on the portable support cushion.

The invention claimed is:

1. A toilet system comprising a toilet including a bowl, a toilet seat pivotably arranged on a top rim of the bowl, and a toilet seat lid pivotably arranged above the toilet seat, the toilet seat lid including a bottom surface that faces the toilet seat in a lowered position when the toilet seat lid is resting on top of the toilet seat and a top surface opposite the bottom surface, where the toilet seat lid pivotally connects to the toilet seat at a first end of the toilet seat lid and the toilet seat lid has a second end opposite to the first end, and a portable support cushion including a cushion body including a front body surface configured to engage a body of a user and a rear body surface arranged to face opposite the front body surface, a cushion cover surrounding the cushion body so as to enclose the cushion body therein, the cushion cover including a front cover surface adjacent the front body surface and a rear cover surface adjacent the rear body surface where the rear body surface contacts substantially all of either the upper or lower surface of the toilet seat lid, and a support pouch coupled to the rear cover surface and changeable between an expanded arrangement and a collapsed arrangement, the support pouch comprising an elastic material, wherein, in the expanded arrangement, the support pouch is configured to be stretched and arranged around at least a portion of the toilet seat lid such that elastic force of the elastic material causes the support pouch to grasp the toilet seat lid so as to mount the portable support cushion on the toilet seat lid such that only the second end of the toilet seat lid is completely contained in the support pouch leaving the first end of the toilet seat cover outside the support pouch.

2. The toilet system of claim 1, wherein, in the expanded arrangement, the support pouch is formed to include a pouch cavity and a pouch opening arranged to open into the pouch cavity, and wherein, in the expanded arrangement, the toilet seat lid extends through the pouch opening and into the pouch cavity when the portable support cushion is mounted on the toilet seat lid.

3. The toilet system of claim 2, wherein the support pouch includes a rear wall and a perimeter side wall arranged to extend between and interconnect the rear wall and the rear cover surface, wherein the pouch cavity is defined, at least in part, to be between the rear wall, the perimeter side wall, and the rear cover surface, and wherein, in the expanded arrangement, the rear wall is arranged on one of the bottom and top surface of the toilet seat lid and the rear cover surface is arranged on the other of the bottom and top surface of the toilet seat lid when the portable support cushion is mounted on the toilet seat lid.

4. The toilet system of claim 3, wherein, in the expanded arrangement, the rear wall of the support pouch is spaced apart from the rear cover surface so as to define the pouch cavity, and, in the collapsed arrangement, the perimeter side wall is collapsed such that the rear wall is located adjacent to the rear cover surface.

5. The toilet system of claim 4, wherein, in the expanded arrangement, an inner top portion of the perimeter side wall of the support pouch is arranged on a top side of the toilet seat lid when the portable support cushion is mounted on the toilet seat lid, and wherein the support pouch is positioned on the cushion cover such that a bottommost end of the cushion body and the cushion cover is spaced apart from a bottommost terminal end of the toilet seat lid closest to the toilet seat.

6. The toilet system of claim 4, wherein the support pouch is arranged on a top half of the rear cover surface such that a bottom half of the rear cover surface is configured to contact the toilet seat lid, and wherein the rear wall is generally parallel with the rear cover surface.

7. The toilet system of claim 1, wherein, in a first use arrangement, the support pouch is arranged on the top side of the toilet seat lid when the toilet seat lid is in a raised position away from the toilet seat such that the cushion body is arranged on the bottom surface of the toilet seat lid.

8. The toilet system of claim 1, wherein, in a second use arrangement, the support pouch is arranged on the top side of the toilet seat lid when the toilet seat lid is in the lowered position such that the cushion body is arranged on the top surface of the toilet seat lid.

9. The toilet system of claim 1, wherein, in a third use arrangement, the support pouch is arranged in the collapsed arrangement such that a rear wall of the support pouch is substantially aligned with the rear cover surface so as to allow the portable support cushion to rest on a flat surface on the rear cover surface such that a user can rest on the portable support cushion.

10. A portable support cushion comprising a cushion body including a front body surface configured to engage a body of a user and a rear body surface arranged to face opposite the front body surface, a cushion cover surrounding the cushion body so as to enclose the cushion body therein, the cushion cover including a front cover surface adjacent the front body surface and a rear cover surface adjacent the rear body surface, a support pouch coupled to the rear cover surface and changeable between an expanded arrangement and a collapsed arrangement, the support pouch comprising an elastic material, wherein, in the expanded arrangement, the support pouch is configured to be stretched and arranged around at least a portion of a cushion support such that elastic force of the elastic material causes the support pouch to grasp the cushion support so as to mount the portable support cushion on the cushion support, and where the support pouch completely covers only one end of a toilet seat lid leaving the other end outside the support pouch.

11. The portable support cushion of claim 10, wherein, in the expanded arrangement, the support pouch is formed to include a pouch cavity and a pouch opening arranged to open into the pouch cavity, and wherein, in the expanded arrangement, the cushion support extends through the pouch opening and into the pouch cavity when the portable support cushion is mounted on the cushion support.

12. The portable support cushion of claim 11, wherein the support pouch includes a rear wall and a perimeter side wall extending between and interconnecting the rear wall and the rear cover surface, wherein the pouch cavity is defined between the rear wall, the perimeter side wall, and the rear cover surface, wherein, in the expanded arrangement, the rear wall is arranged on a first support surface of the cushion support and the rear cover surface is arranged on a second support surface of the cushion support opposite the first support surface in the expanded arrangement when the portable support cushion is mounted on the cushion support, and wherein, in the expanded arrangement, the rear wall of the support pouch is spaced apart from the rear cover surface so as to define the pouch cavity, and, in the collapsed arrangement, the perimeter side wall is collapsed such that the rear wall is located adjacent to the rear cover surface.

13. The portable support cushion of claim 12, wherein, in the expanded arrangement, an inner top portion of the perimeter side wall of the support pouch is arranged on a top end of the cushion support when the portable support cushion is mounted on the cushion support, and wherein the support pouch is positioned on the cushion cover such that a bottommost end of the cushion body and the cushion cover is spaced apart from a bottommost terminal end of the cushion support.

14. The portable support cushion of claim 12, wherein the support pouch is arranged on a top half of the rear cover surface such that a bottom half of the rear cover surface is configured to contact the cushion support, and wherein the rear wall is generally parallel with the rear cover surface.

15. The portable support cushion of claim 10, wherein the cushion cover includes an opening on a bottommost side of the cushion cover that is selectively openable and closable via a zipper, the opening configured to allow the cushion body to be removed front the cushion cover when the opening is opened via the zipper.

16. The portable support cushion of claim 15, wherein the cushion cover further includes a flap strip that extends over an entirety of the opening and the zipper, wherein the opening extends from a first terminal end located on a first lateral side of the cushion cover to a second terminal end located on a second lateral side of the cushion cover opposite the first lateral side, and wherein the flap strip extends from the first terminal end to the second terminal end of the opening.

17. The portable support cushion of claim 16, wherein a first longitudinal edge of the flap strip is a hinge edge that is attached to the cushion cover, and wherein a second longitudinal edge of the flap strip opposite the first longitudinal edge is not attached to the cushion cover so as to allow the flap strip to pivot about the hinge edge between an opened arrangement in which the zipper is exposed to a surrounding environment and a closed arrangement in which the zipper is covered.

18. A method of using a portable support cushion comprising providing a toilet seat lid of a toilet having a bottom surface that faces a toilet seat of the toilet in a lowered position and a top surface opposite the bottom surface, arranging the toilet seat lid in a raised position away from the toilet seat, and arranging a support pouch of the portable support cushion that is arranged on a rear side of a cushion body of the portable support cushion to completely cover only on a top side of the toilet seat lid such that the cushion body is arranged on the bottom surface of the toilet seat lid and is aligned with a lumbar region of a user so as to allow the user to lean back on the portable support cushion.

19. The method of claim 18, further comprising removing the support pouch from the top side of the toilet seat lid so as to remove the portable support cushion from the toilet seat lid, moving the toilet seat lid to the lowered position, and arranging the support pouch on the top side of the toilet seat lid such that the cushion body is arranged on the top surface of the toilet seat lid and is aligned with an underside of an upper leg region of the user so as to allow the user to sit on the portable support cushion.

20. The method of claim 18, further comprising removing the support pouch from the top side of the toilet seat lid so as to remove the portable support cushion from the toilet seat lid, moving the support pouch to a collapsed arrangement such that a rear wall of the support pouch is substantially aligned with a rear surface of the cushion body, and arranging the portable support cushion on a flat surface on the rear surface of the cushion body such that the user can rest on the portable support cushion.

* * * * *